US010981266B2

(12) United States Patent
Mochizuki

(10) Patent No.: US 10,981,266 B2
(45) Date of Patent: Apr. 20, 2021

(54) AIR DUSTER STRUCTURE AND DRIVING TOOL

(71) Applicant: MAX CO., LTD., Tokyo (JP)

(72) Inventor: Kazuya Mochizuki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 128 days.

(21) Appl. No.: 15/848,326

(22) Filed: Dec. 20, 2017

(65) Prior Publication Data

US 2018/0178363 A1 Jun. 28, 2018

(30) Foreign Application Priority Data

Dec. 28, 2016 (JP) ..... JP2016-256590

(51) Int. Cl.
*B25C 1/04* (2006.01)

(52) U.S. Cl.
CPC ..... *B25C 1/047* (2013.01)

(58) Field of Classification Search
CPC ..... B25C 1/047
See application file for complete search history.

(56) References Cited

U.S. PATENT DOCUMENTS 5,085,126 A * 2/1992 Mukoyama ..... B25D 9/14 91/426
6,783,050 B2 * 8/2004 Ishizawa ..... B25C 1/047 227/130
7,322,505 B2 * 1/2008 Ishizawa ..... B25C 1/047 227/130
7,438,207 B2 * 10/2008 Wu ..... B25C 1/047 227/130
9,339,925 B2 * 5/2016 Liu ..... B25F 5/00
2005/0001069 A1 * 1/2005 Ishizawa ..... B25C 1/047 239/525

(Continued)

FOREIGN PATENT DOCUMENTS

EP 1128109 A1 * 8/2001 ..... F16K 1/385
EP 1366863 A2 12/2003

(Continued)

OTHER PUBLICATIONS

Extended European Search Report dated Jun. 18, 2018 in corresponding European patent application No. 17210101.6 (9 pages).

(Continued)

*Primary Examiner* — Andrew M Tecco
(74) *Attorney, Agent, or Firm* — Rothwell, Figg, Ernst & Manbeck, P.C.

(57) ABSTRACT

An air duster structure that is configured to jet compressed air out of a nozzle, includes a flow amount adjustment mechanism which is configured to adjust an amount of air jetted out of the nozzle. The flow amount adjustment mechanism includes: a pipe line for circulating air; a valve member disposed inside the pipe line and being movable; and a throttle portion configured to gradually change an area of a flow channel in which air circulates, with a movement of the valve member, to control a flow amount of the air in the pipe line. The throttle portion is structured so as to increase the area of the flow channel at an accelerated rate when the valve member moves in a direction that opens the pipe line.

11 Claims, 19 Drawing Sheets

(56) References Cited

U.S. PATENT DOCUMENTS

| | | | | |
|---|---|---|---|---|
| 2008/0087704 | A1* | 4/2008 | Wen | B25C 1/04 227/130 |
| 2008/0105729 | A1* | 5/2008 | Wu | B25C 1/047 227/130 |
| 2009/0242604 | A1* | 10/2009 | Mina | B25C 1/047 227/8 |
| 2012/0000031 | A1* | 1/2012 | Liu | B25C 1/08 15/339 |

FOREIGN PATENT DOCUMENTS

| | | | |
|---|---|---|---|
| EP | 2402121 | A2 | 1/2012 |
| JP | H10-109280 | A | 4/1998 |
| JP | 2008-173767 | A | 7/2008 |
| JP | 2009-220204 | A | 10/2009 |
| JP | 2013-248735 | A | 12/2013 |

OTHER PUBLICATIONS

Office Action issued for corresponding Japanese Application No. 2016-256590 dated May 26, 2020 (12 pages).
Extended European Search Report issued for corresponding European Application No. 20201940.2 dated Mar. 5, 2021 (5 pages).

* cited by examiner

AIR DUSTER STRUCTURE AND DRIVING TOOL

CROSS-REFERENCE TO RELATED APPLICATION(S)

This application is based upon and claims the benefit of priority from prior Japanese patent application No. 2016-256590, filed on Dec. 28, 2016, the entire contents of which are incorporated herein by reference.

BACKGROUND

The present disclosure relates to an air duster structure that jets air from a nozzle by using externally supplied compressed air and to a driving tool provided with the air duster structure.

An air duster gun or an air duster included with a driving tool has been used in order to blow off fine wood debris and the like before performing nail driving. For example, JP-A-H10-109280 discloses a driving tool including an air duster. The related-art technique disclosed in JP-A-H10-109280 is structured so that air is jetted out of a nozzle by pushing in an operation button that opens and closes a release valve.

To adjust the amount of air jetted out of the nozzle according to the operation amount of the operation button in an air duster as described above, it is considered to form the release valve or a pipe line in a tapered shape to increase the area of the flow channel of the air according to the pushing amount of the operation button. At this time, if the flow amount gradually increases while the pushing amount of the operation button and the flow amount of the air maintain a proportional relationship therebetween, and the flow amount of the air is largest when the operation amount is highest, operability is excellent.

However, in actuality, as the flow amount of the air being jetted out increases, the pressure in the accumulator provided on the upstream side of the release valve decreases and the difference in the pressure between in front of and behind the throttle of the release valve becomes small, so that the change in the flow amount with respect to the change in the operation amount becomes small. This produces an inconvenience in that after the operation button is operated to a certain extent, even if the operation button is operated any further, the amount of air jetted out of the nozzle does not largely change and this deteriorates operability.

SUMMARY

Accordingly, an object of the present disclosure is to provide an air duster structure and a driving tool where the adjustment of the flow amount of the air being jetted out is easy.

According to an aspect of the disclosure, there is provided an air duster structure that is configured to jet compressed air out of a nozzle, the air duster structure comprising: a flow amount adjustment mechanism which is configured to adjust an amount of air jetted out of the nozzle, wherein the flow amount adjustment mechanism includes: a pipe line for circulating air; a valve member disposed inside the pipe line and being movable; and a throttle portion configured to gradually change an area of a flow channel in which air circulates, with a movement of the valve member, to control a flow amount of the air in the pipe line, and the throttle portion is structured so as to increase the area of the flow channel at an accelerated rate when the valve member moves in a direction that opens the pipe line.

BRIEF DESCRIPTION OF THE DRAWINGS

FIG. 8 is a cross-sectional view of the flow amount adjustment mechanism according to the first embodiment, and a view of a condition where the operation portion is depressed all the way in.

FIG. 9A is a view of the condition where the operation portion is not operated, FIG. 9B is a view of a condition where the operation portion is operated approximately ⅓ the way, FIG. 9C is a view of a condition where the operation portion is operated approximately ⅔ the way, and FIG. 9D is a view of a condition where the operation portion is fully operated.

FIG. 12 is a cross-sectional view of the flow amount adjustment mechanism according to the second embodiment, and a view of a condition where the operation portion is depressed all the way in.

FIG. 13A is a view of the condition where the operation portion is not operated, FIG. 13B is a view of a condition where the operation portion is operated approximately ¼ the way, FIG. 13C is a view of a condition where the operation portion is operated approximately ¾ the way, FIG. 13D is a view of a condition where the operation portion is operated approximately ¾ the way, and FIG. 13E is a view of a condition where the operation portion is fully operated.

FIG. 16 is a cross-sectional view of the flow amount adjustment mechanism according to the third embodiment, and a view of a condition where the operation portion is depressed all the way in.

FIG. 17A is a view of the condition where the operation portion is not operated, FIG. 17B is a view of a condition where the operation portion is operated approximately ⅓ the way, FIG. 17C is a view of a condition where the operation portion is operated approximately ⅔ the way, and FIG. 17D is a view of a condition where the operation portion is fully operated.

FIG. 18A is a view of a condition where the flow amount of the air is controlled by the change of the clearance amount at a throttle portion, and FIG. 18B is a view of the condition where the flow amount of the air is controlled by the change of the opening amount of the opening portion.

DETAILED DESCRIPTION OF EXEMPLARY EMBODIMENTS

Hereinafter, embodiments of the present disclosure will be described with reference to the drawings. While in the following embodiments, as a usage example of the air duster structure, a driving tool 10 provided with an air duster structure is cited as an example, the present disclosure is not limited thereto; the air duster structure according to the present disclosure may be applied to different tools. For example, the air duster structure according to the present embodiments may be applied to an air duster gun.

First Embodiment

A first embodiment of the present disclosure will be described with reference to FIGS. 1 to 10.

The driving tool 10 according to the present embodiment ejects a fastener by using externally supplied compressed air, and is provided with an air duster structure that jets air out of a nozzle 17*b* by using this externally supplied compressed air. By thus providing the driving tool 10 with the air duster structure, driving by the fastener and cleaning by the air duster can be performed without exchanging tools.

Figure 1:
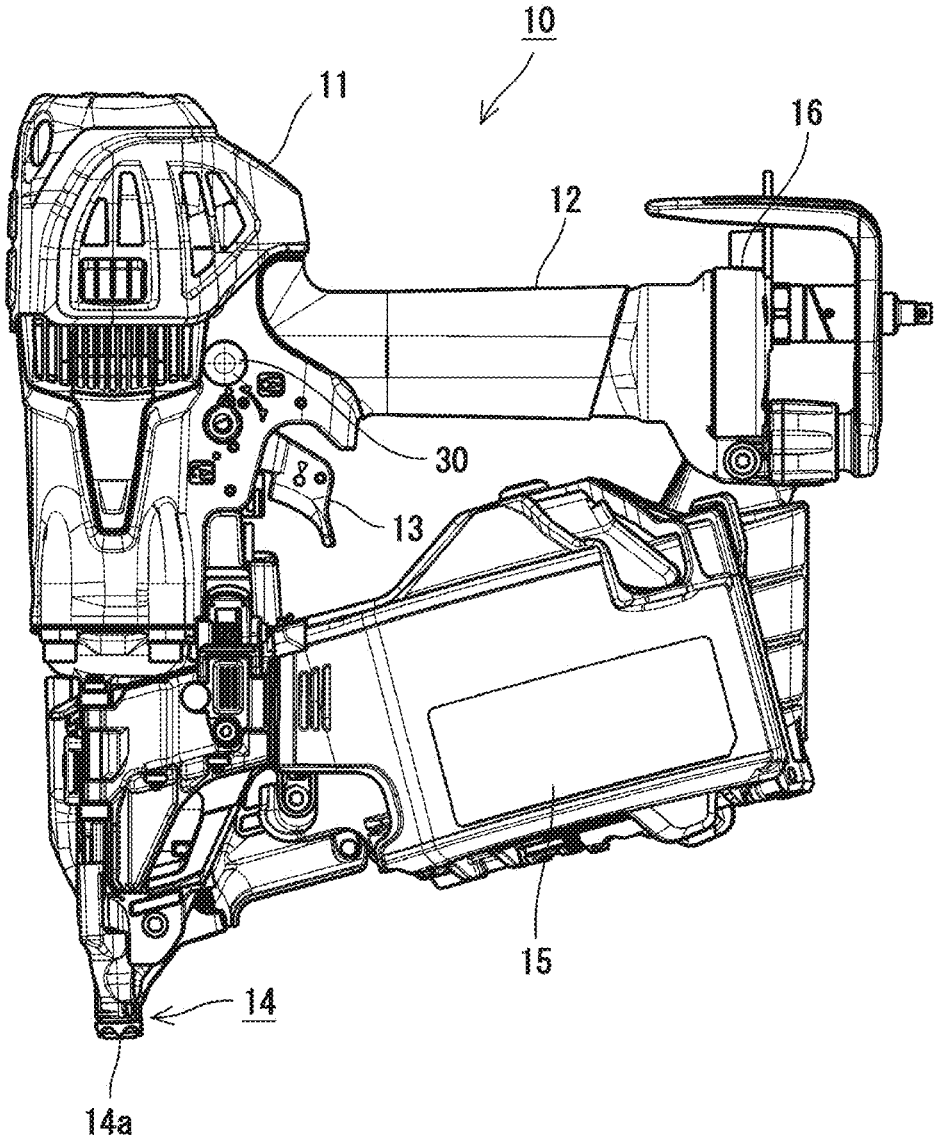
FIG. 1 is a right side view of a driving tool provided with an air duster structure.

As shown in FIG. 1, this driving tool 10 is provided with a tool body 11 having a striking mechanism inside, a grip 12 provided so as to protrude from the tool body 11 in an orthogonal direction, a trigger 13 provided on the grip 12 so as to be operable, a nose portion 14 provided so as to protrude on the tip of the tool body 11, a magazine 15 connected in the rear of the nose portion 14, and an operation portion 30 provided so as to be depressable in order to actuate the air duster structure.

The striking mechanism incorporated in the tool body 11 actuates a driver (which is a fastener driving member) by using the force of the compressed air. The driver is movable in the direction toward the nose portion 14 in order to eject a fastener. The driver having moved in the driving direction ejects a fastener that is set inside the nose portion 14. The fastener ejected by the driver is ejected from an ejection hole 14*a* that is open at the tip of the nose portion 14.

When this driving tool 10 is used, the grip 12 is gripped and grasped, and the trigger 13 is pulled. By this operation, the above-described striking mechanism is actuated to eject a fastener.

In the magazine 15, a connection fastener is accommodated, and the foremost fasteners of this connection fastener are successively supplied in the direction toward the nose portion 14 (immediately below the driver before the driving operation).

The compressed air for actuating the above-described striking mechanism and air duster structure is supplied from an air supply source such as an air compressor. Specifically, an air hose for supplying air connected to a compressor or the like is connected to an end cap portion 16 provided on the rear end of the grip 12, and the compressed air is supplied through this air hose. The compressed air supplied from the end cap portion 16 passes through an air supply channel formed inside the grip 12, and is supplied to the striking mechanism or to the air duster structure.

In the striking mechanism, when the trigger 13 is operated, the compressed air is supplied into a striking cylinder, this compressed air acts on a striking piston to drive the striking piston, and the driver coupled to the striking piston drives a nail.

In the air duster structure, when the operation portion 30 is operated, the compressed air is jetted out of the nozzle 17*b* that is open in the neighborhood of the nose portion 14. As shown in FIG. 1, the operation portion 30 according to the present embodiment is disposed in a position where it can be operated with the hand grasping the grip 12 when the worker grasps the grip 12. Specifically, it is disposed in a position where it can be operated with the thumb of the right hand when the grip 12 is gripped with the right hand.

Figure 3:
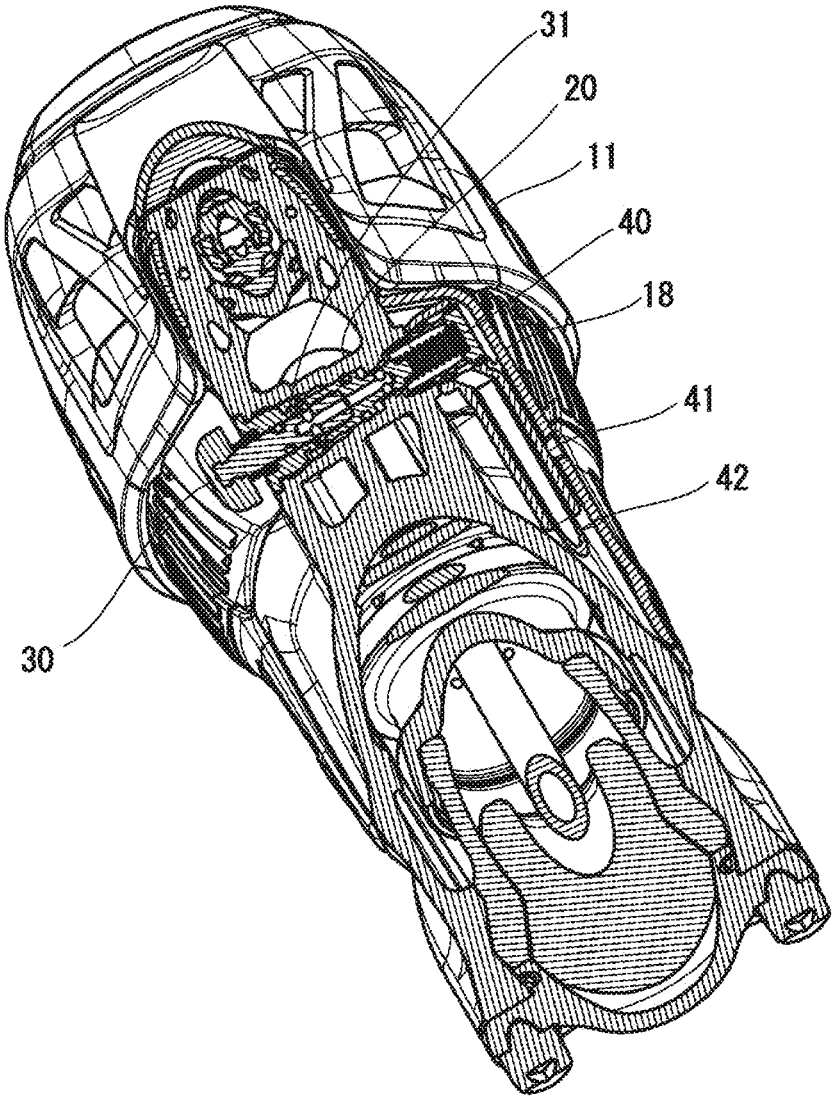
FIG. 3 is an A-A cross-sectional view of the driving tool.
Figure 4:
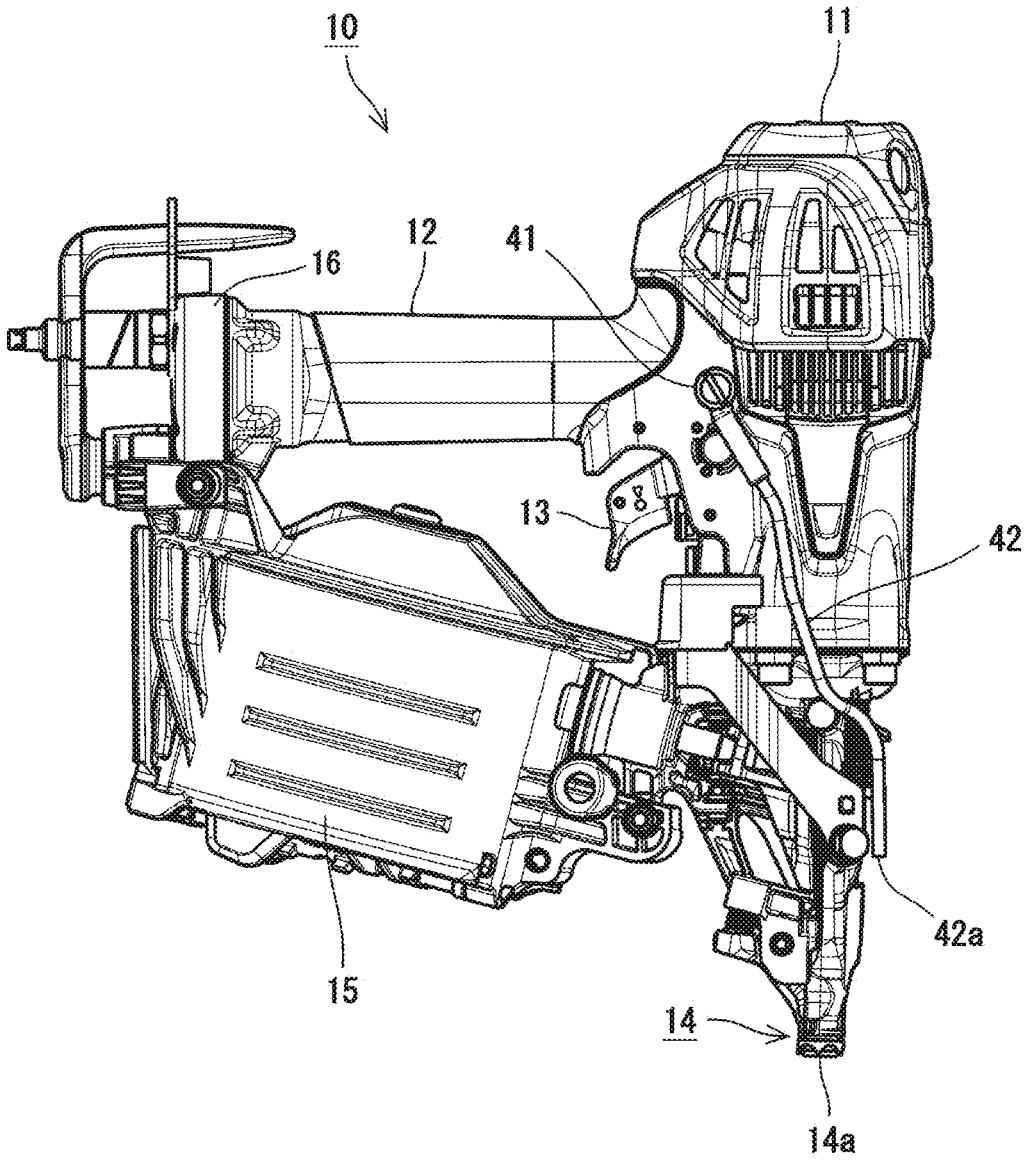
FIG. 4 is a left side view of the driving tool from which a tip cover member and a side cover member are detached.

As shown in FIGS. 3 and 4, the above-described air duster structure is provided with a flow amount adjustment mechanism provided inside the housing of the tool body 11. On the downstream side of this flow amount adjustment mechanism, an air outlet 40 for taking out air to the outside of the housing is provided. To this air outlet 40, a duster pipe arrangement 42 extending in a direction toward the tip of the tool body 11 (that is, a direction toward the nose portion 14) is connected. More specifically, the duster pipe arrangement 42 is connected through a joint part 41 rotatably provided between it and the air outlet 40.

Figure 2:
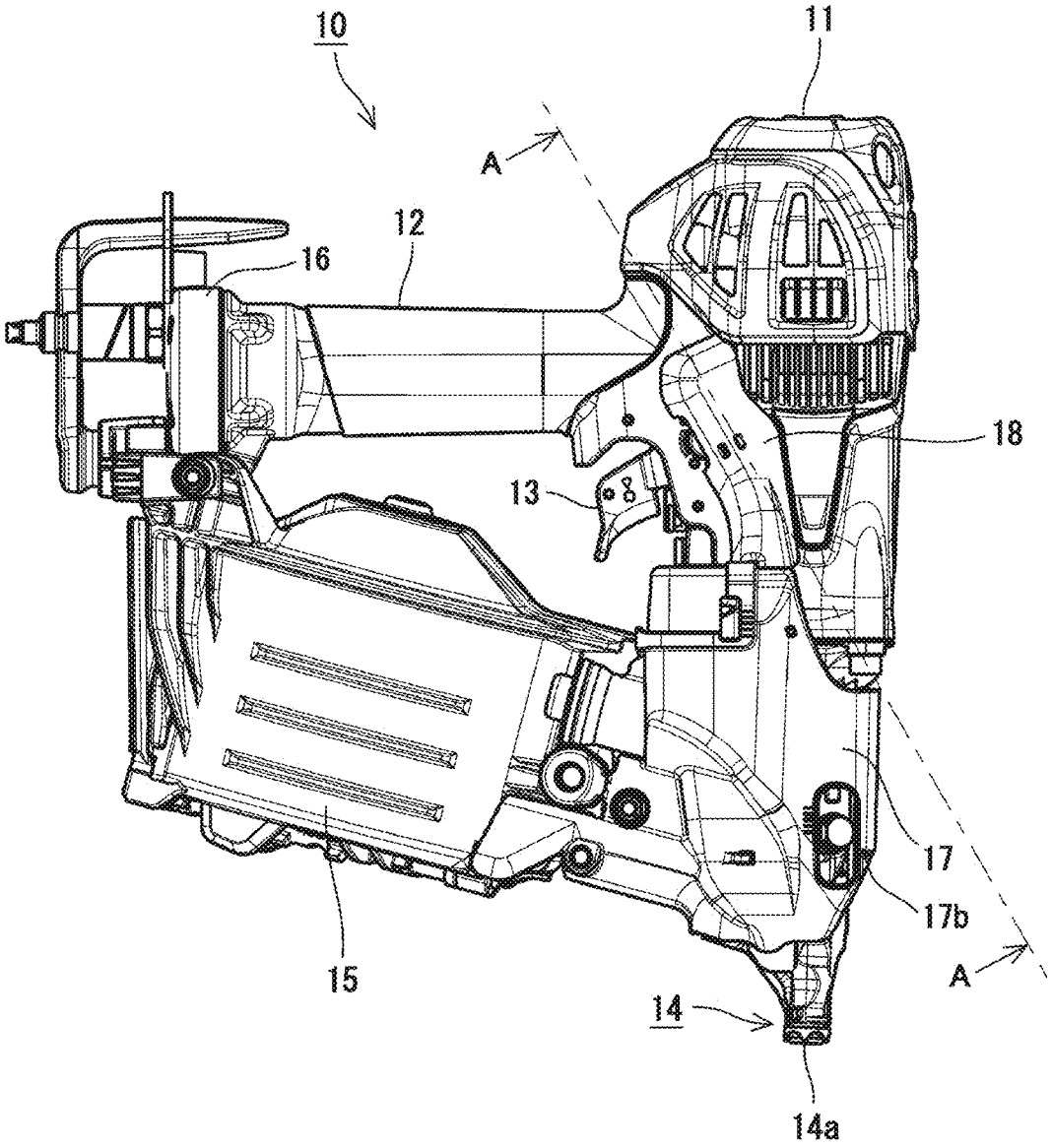
FIG. 2 is a left side view of the driving tool provided with the air duster structure.

The air outlet 40 is disposed on a side surface of the tool body 11 on the side opposite to the operation portion 30. While the duster pipe arrangement 42 and the joint part 41 connected to the air outlet 40 are disposed outside the housing of the tool body 11, as shown in FIG. 2, they are covered with a tip cover member 17 covering the tip of the tool body 11 and a side cover member 18 disposed in a position covering the air outlet 40.

Figure 5A:
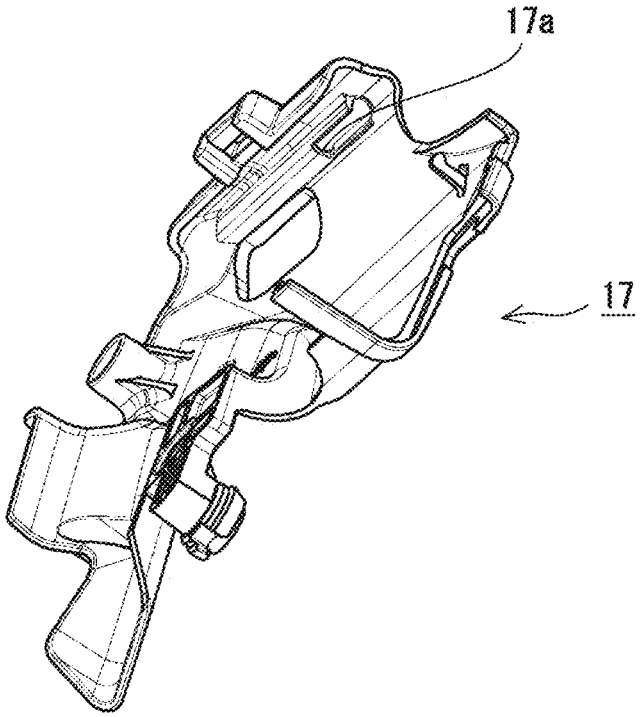
FIG. 5A is a perspective view of the tip cover member viewed from the reverse side.

On the reverse side of the tip cover member 17, as shown in FIG. 5A, a pipe arrangement holding portion 17*a* holding a tip portion 42*a* of the duster pipe arrangement 42 is provided, and by this, the tip portion 42*a* of the duster pipe arrangement 42 is fixed by the tip cover member 17. The duster pipe arrangement 42 is easily assembled to the pipe arrangement holding portion 17*a* since it is a flexible tube made of a resin or the like and elastically deformable.

Figure 5B:
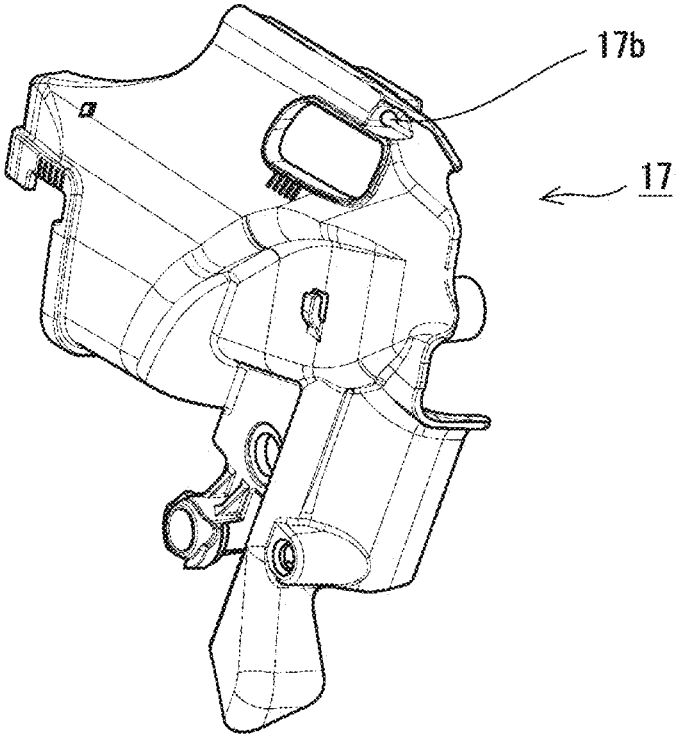
FIG. 5B is a perspective view of the tip cover member viewed from the obverse side.
Figure 6:
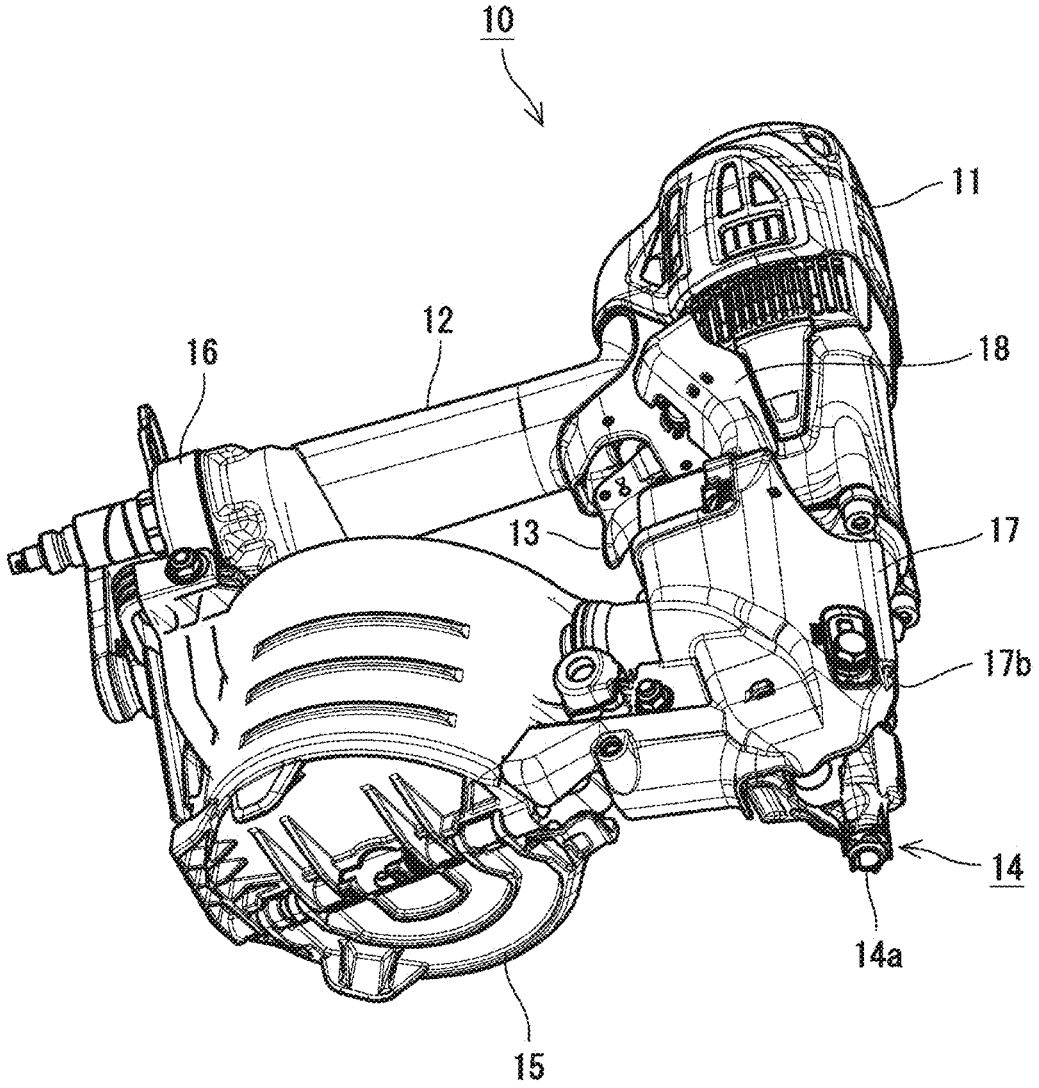
FIG. 6 is a perspective view of the driving tool viewed from below.

On the obverse side of the tip cover member 17, as shown in FIGS. 5B and 6, the air nozzle 17*b* is open. This air nozzle 17*b* communicates with the above-described pipe arrangement holding portion 17*a*. By this provision, on the tip cover member 17, of the air nozzle 17*b* communicating with the duster pipe arrangement 42, air is jetted out of this nozzle 17*b* when the operation portion 30 is operated.

Figure 7:
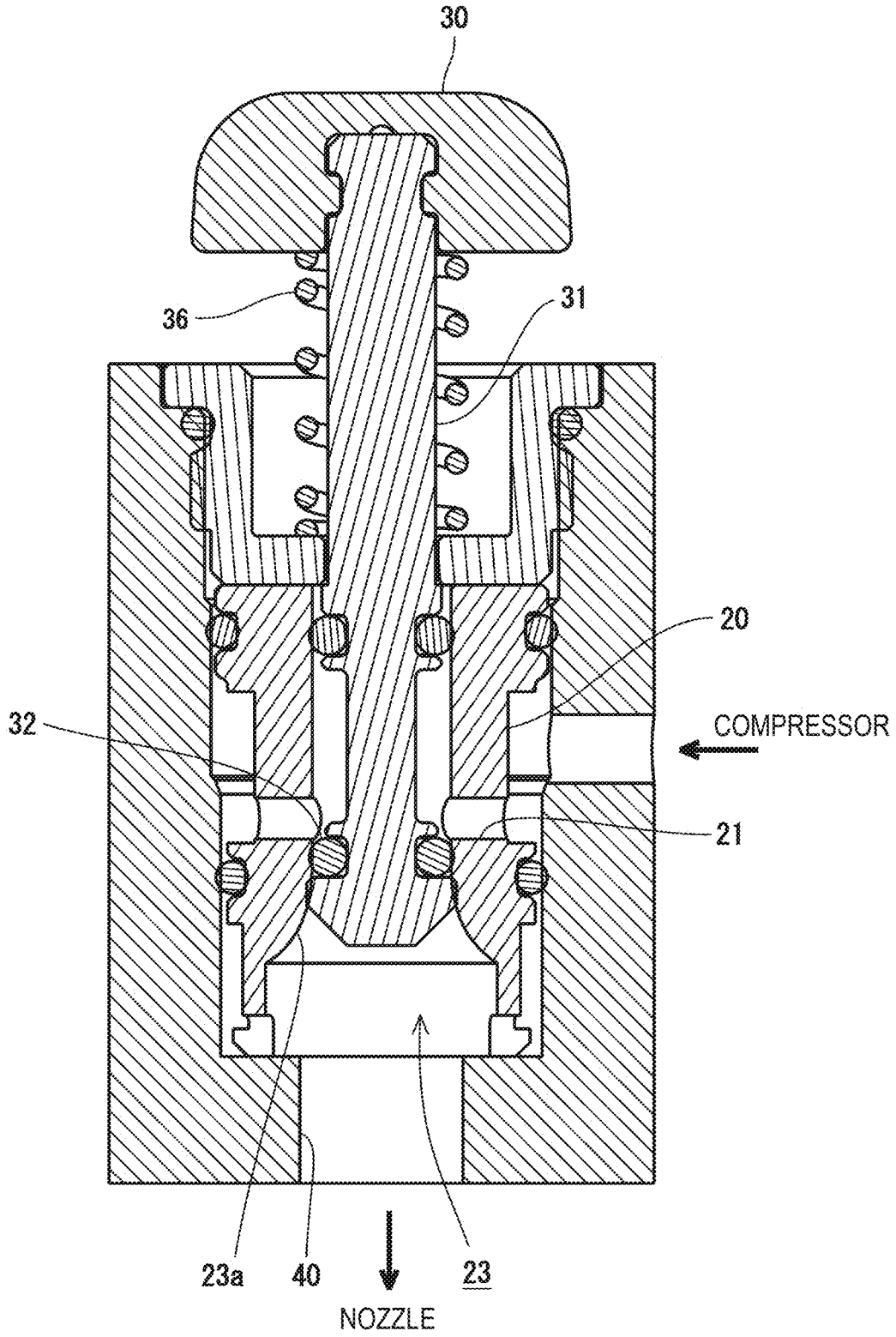
FIG. 7 is a cross-sectional view of a flow amount adjustment mechanism according to a first embodiment, and a view of a condition where an operation portion is not operated.

The flow amount adjustment mechanism is for adjusting the amount of air jetted out of the nozzle 17*b*, and as shown in FIG. 7, is provided with a pipe line formation portion 20 forming a pipe line 23 for circulating air, a valve member 31 disposed within the pipe line 23 and movable, the operation portion 30 disposed on the tip of the valve member 31 so as to be operable, and a valve member pushing member 36 that pushes the valve member 31 in the protruding direction. Into this flow amount adjustment mechanism, the compressed air can be introduced from the upstream side, and when the air supply source such as an air compressor and the tool body 11 are connected together, the compressed air is supplied to the upstream side at all times. On the downstream side of this flow amount adjustment mechanism, the air outlet 40 to which the duster pipe arrangement 42 (the joint part 41) is connectable is open.

Figure 8:
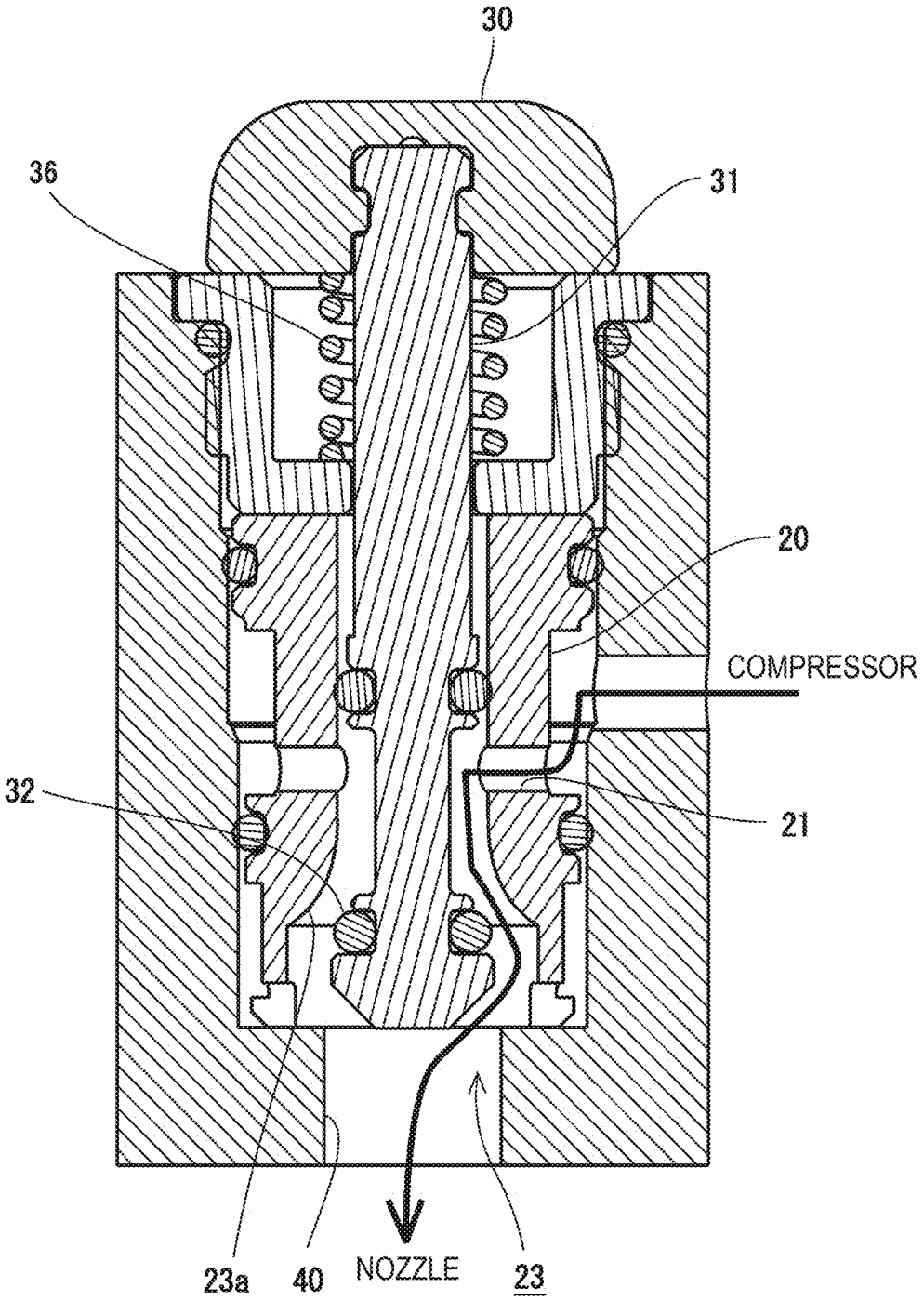
Figure 9A:
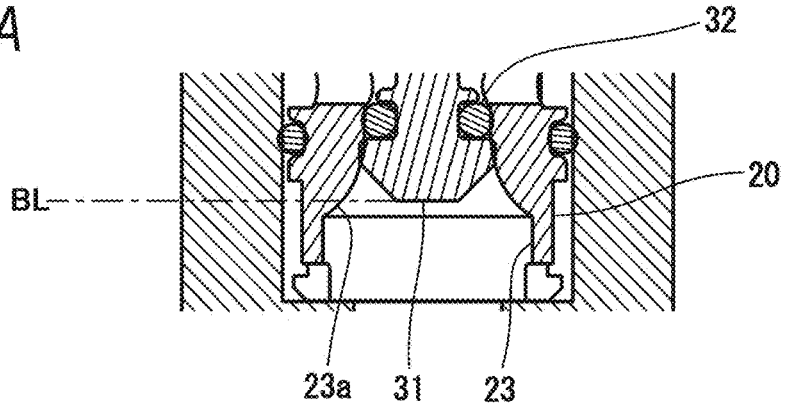
FIGS. 9A to 9D are views explaining the operation of the flow amount adjustment mechanism according to the first embodiment.
Figure 9B:
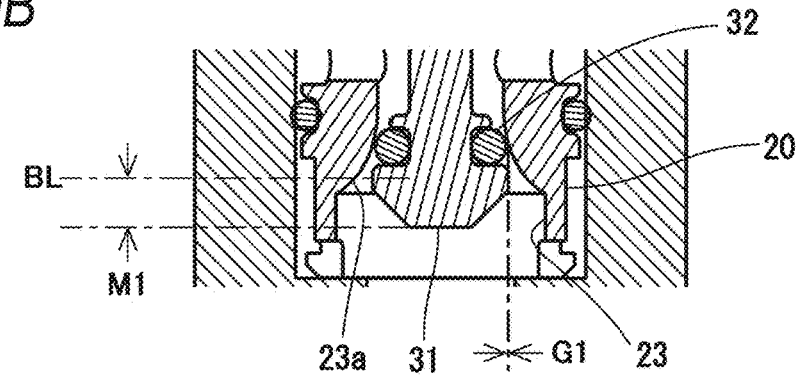
Figure 9C:
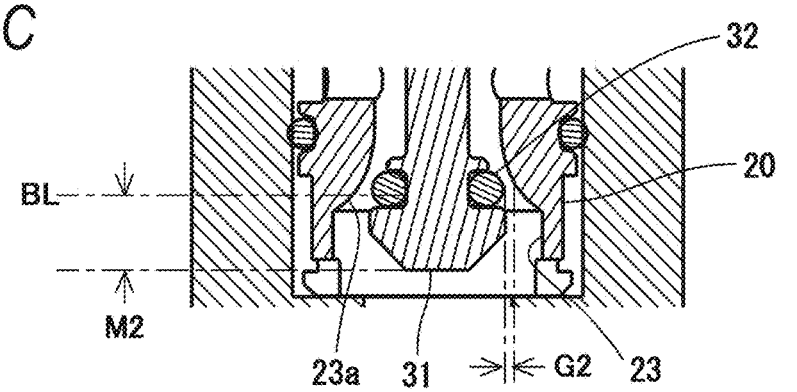
Figure 9D:
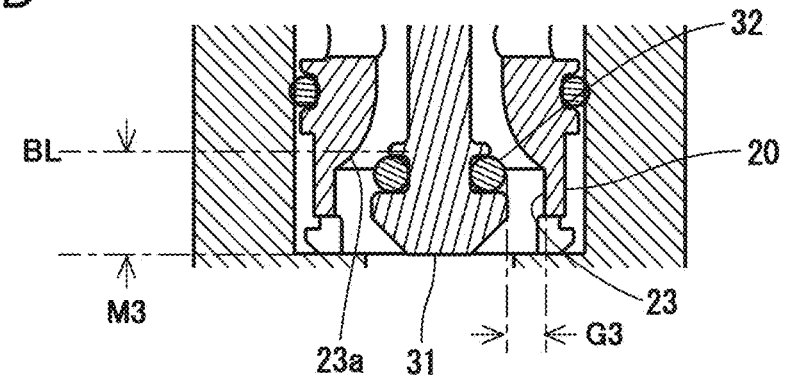

The pipe line formation portion 20 has a hollow portion forming the pipe line 23, and as shown in FIG. 8, is structured so as to take the compressed air into the pipe line 23 through an upstream opening portion 21 that is open toward the upstream side. On the downstream side of the upstream opening portion 21, a throttle portion 23*a* is provided that controls the flow amount of the air in the pipe line 23 by gradually changing the amount of clearance between the pipe line 23 and the valve member 31 when the valve member 31 moves. This throttle portion 23*a* is formed, as shown in FIGS. 7 and 8, in a tapered shape (a trumpet shape) such that the width of the opening (the diameter of the cross section) increases at an accelerated rate toward the movement direction of the valve member 31, and is structured so that when the valve member 31 moves in a direction that opens the pipe line 23, the amount of clearance is increased at an accelerated rate.

To "increase at an accelerated rate" referred to here means not that the flow channel area increases proportionally to the movement amount of the valve member 31 when the valve member 31 moves in the opening direction but that the flow channel area increases more rapidly than proportionally.

The "amount of clearance" referred to here means the length of the gap between the pipe line 23 and the valve member 31.

The valve member 31 is structured so as to slide along with the depression of the operation portion 30. While the valve member 31 is pushed in the protruding direction by the valve member pushing member 36 under natural conditions, when the operation portion 30 is depressed against the pushing force of the valve member pushing member 36, the valve member 31 moves in the direction that opens the pipe line 23. In the present embodiment, a tip sealing member 32 formed of an O ring or the like is attached to the tip of the valve member 31, and under natural conditions, the pipe line 23 is closed by this tip sealing member 32 abutting on the throttle portion 23*a*. When the valve member 31 moves in the direction that opens the pipe line 23, a clearance occurs between the tip sealing member 32 and the throttle portion 23*a*, and by this clearance, the flow amount of the air in the pipe line 23 is controlled. Then, when the valve member 31 opens the pipe line 23, air is released from the air outlet 40, and air is jetted out of the nozzle 17*b*. In the present embodiment, it is unnecessary to dispose the duster pipe arrangement 42 inside the housing since the valve member 31 and the air outlet 40 are disposed in the pushing direction of the operation portion 30 and the air outlet 40 is formed on the side opposite to the operation portion 30.

According to this structure, since the flow channel area of the throttle portion 23*a* rapidly increases as the operation amount of the operation portion 30 increases, even if the difference in pressure between in front of and behind the throttle portion 23*a* becomes small by operating the operation portion 30 to a certain extent, the decrease in the flow amount because of the decrease in the pressure difference can be compensated by the increase in the flow channel area, so that the relationship between the operation amount of the operation portion 30 and the amount of air jetted out of the nozzle 17*b* can be made close to a proportional relationship.

Figure 20:
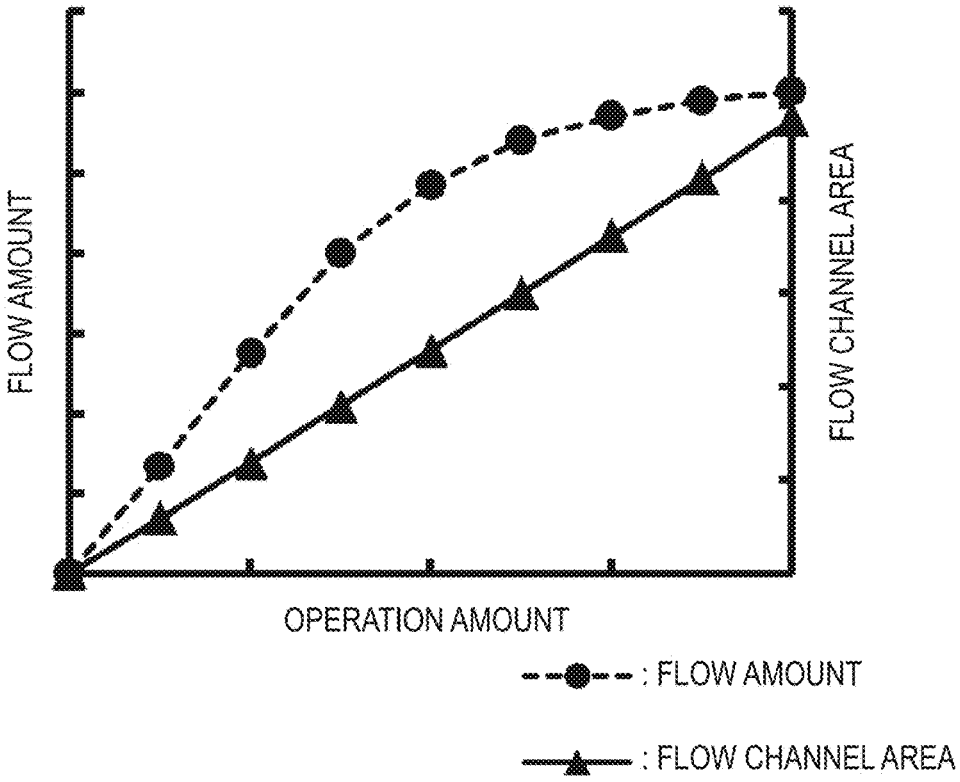
FIG. 20 is a graph showing the relationship between the operation amount, and the flow amount and the flow channel area when a release valve or a pipe line is formed in a simple tapered shape.

That is, when the throttle portion 23*a* is formed not in the trumpet shape but in a simple tapered shape (conical surface), as shown in FIG. 20, as the flow amount of the air increases, the pressure in the accumulator provided on the upstream side of the release valve decreases and the pressure difference between in front of and behind the throttle of the release valve becomes small, so that the change in the flow amount with respect to the change in the operation amount becomes small. For this reason, after the operation portion 30 is operated to a certain extent, the amount of air jetted out of the nozzle 17*b* does not largely change even if the operation portion 30 is operated any further and this deteriorates operability.

Figure 10:
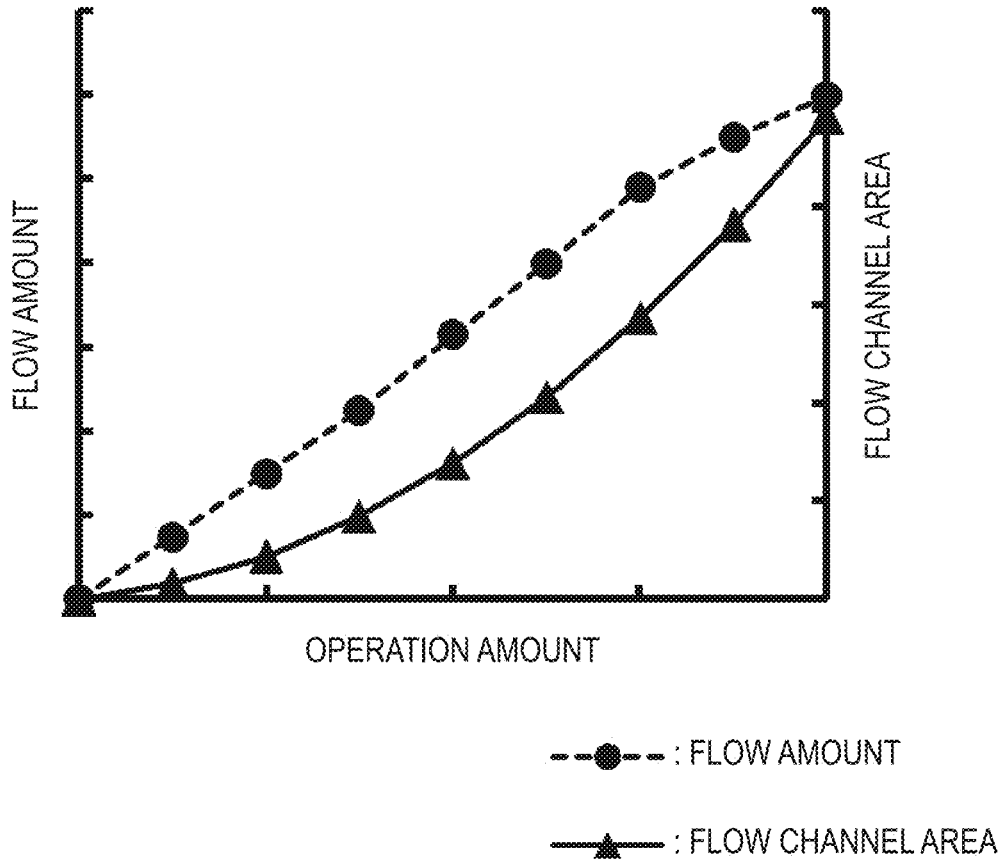
FIG. 10 is a graph showing a relationship between the operation amount, and the flow amount and the flow channel area according to the first embodiment.

In this regard, according to the present embodiment, as shown in FIGS. 9A to 9D, since operation amounts M1 to M3 of the operation portion 30 are not proportional to the clearance amounts G1 to G3, it is possible to make the flow channel area very small at the start of the operation of the operation portion 30 and make the flow channel area very large at the end of the operation of the operation portion 30. Specifically, when the operation portion 30 is operated by the predetermined operation amount M1 from an initial position BL of the valve member 31 where the flow channel is closed (see FIG. 9A), the clearance amount is G1 (see FIG. 9B). When the operation portion 30 is operated by twice the predetermined operation amount M1 (M2) from the initial position BL of the valve member 31, the clearance amount is G2 (see FIG. 9C). When the operation portion 30 is operated by three times the predetermined operation amount M1 (M3) from the initial position BL of the valve member 31, the clearance amount is G3 (see FIG. 9C). In the case of a simple tapered shape (a conical surface), G2 should be twice G1, and G3 should be three times G1; however, in the present embodiment, since the clearance amount increases at an accelerated rate with respect to the operation amount of the operation portion 30, G2 is not less than twice G1, and G3 is not less than three times G1. As described above, the present embodiment is purposefully structured so that the flow channel area largely increases extremely toward the rear. Therefore, even when the pressure difference between in front of and behind the throttle portion 23*a* becomes small by operating the operation portion 30 to a certain extent and the pressure to jet out the air decreases, the decrease in the pressure can be compensated by the increase in the flow channel area, so that as shown in FIG. 10, the relationship between the operation amount of the operation portion 30 and the amount of air jetted out of the nozzle 17*b* can be made close to a proportional relationship.

Second Embodiment

A second embodiment of the present disclosure will be described with reference to FIGS. 11 to 14. Since the second embodiment is different from the first embodiment only in the structure of the flow amount adjustment mechanism, overlapping descriptions are avoided and only the flow amount adjustment mechanism will be described.

Figure 11:
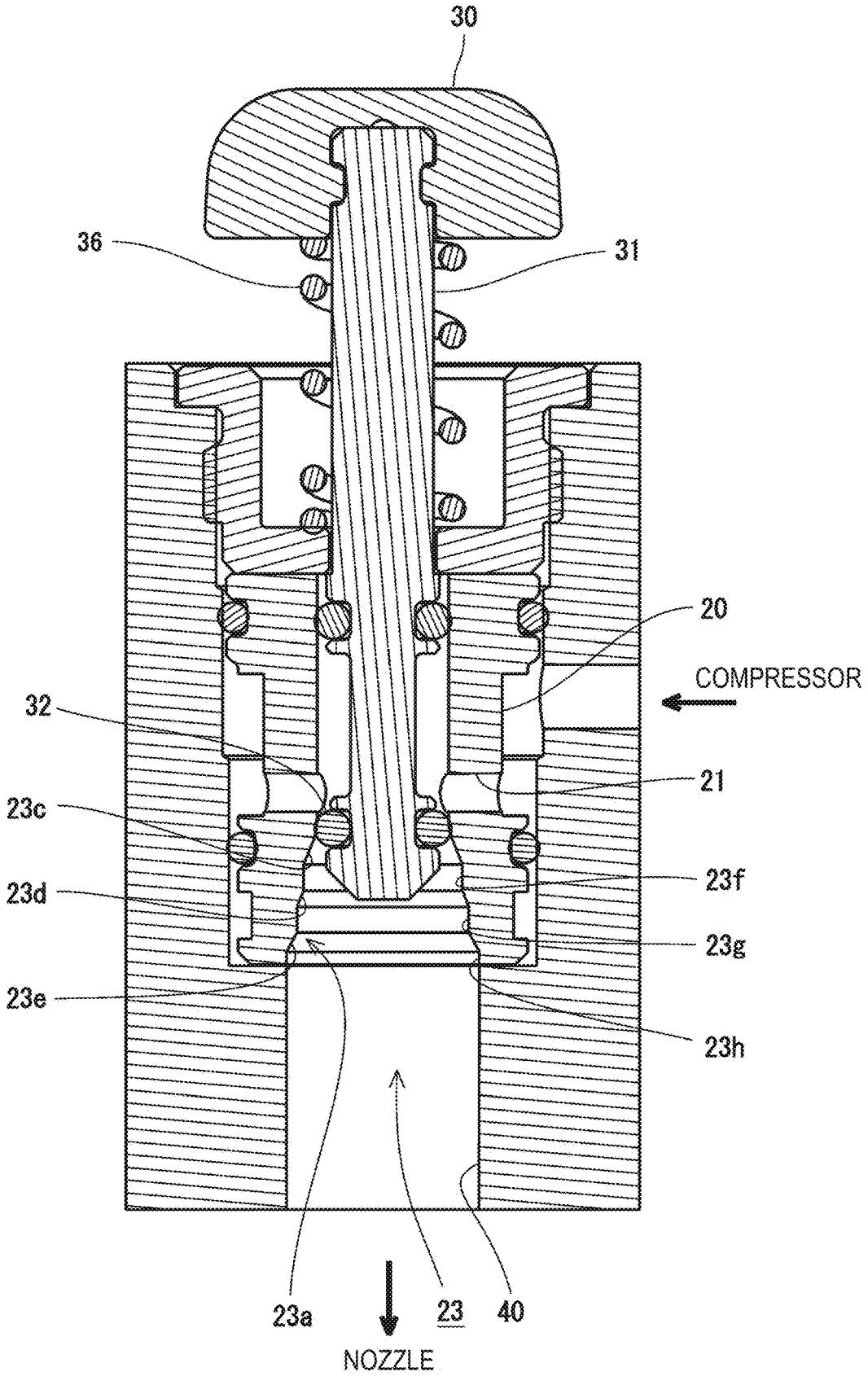
FIG. 11 is a cross-sectional view of a flow amount adjustment mechanism according to a second embodiment, and a view of a condition where the operation portion is not operated.

The flow amount adjustment mechanism according to the present embodiment is for adjusting the amount of air jetted out of the nozzle 17*b*, and as shown in FIG. 11, is provided with the pipe line formation portion 20 forming the pipe line 23 for circulating air, the valve member 31 disposed within the pipe line 23 and movable, the operation portion 30 disposed on the tip of the valve member 31 so as to be operable, and the valve member pushing member 36 that pushes the valve member 31 in the protruding direction. Into this flow amount adjustment mechanism, the compressed air can be introduced from the upstream side, and when the air supply source such as an air compressor is connected to the tool body 11, the compressed air is supplied to the upstream side at all times. On the downstream side of this flow amount adjustment mechanism, the air outlet 40 to which the duster pipe arrangement 42 (the joint part 41) is connectable is open.

Figure 12:
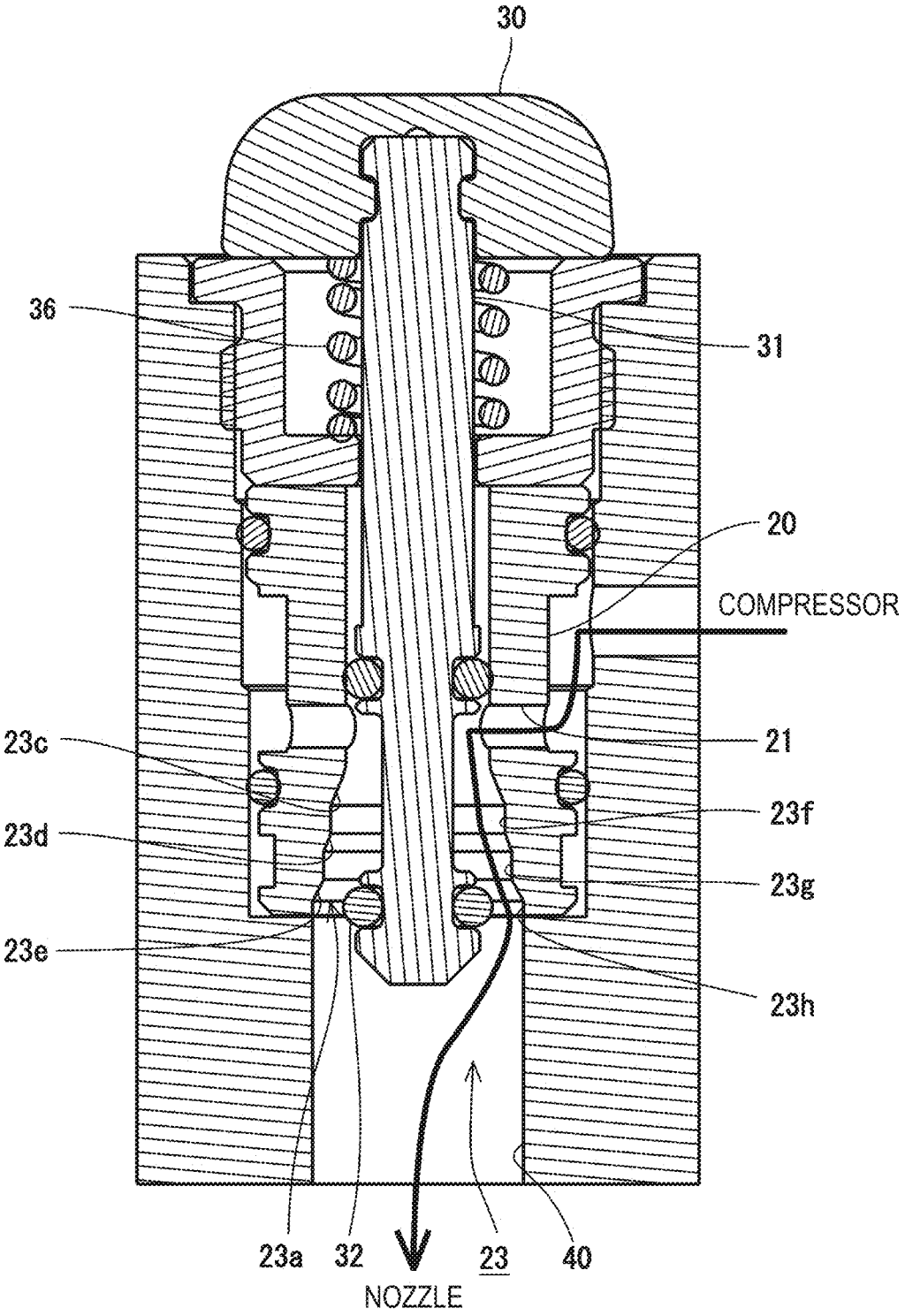

The pipe line formation portion 20 has a hollow portion forming the pipe line 23, and as shown in FIG. 12, is structured so as to take the compressed air into the pipe line 23 through the upstream opening portion 21 that is open toward the upstream side. On the downstream side of the upstream opening portion 21, the throttle portion 23*a* is provided that controls the flow amount of the air in the pipe line 23 by gradually changing the amount of clearance between the pipe line 23 and the valve member 31 when the valve member 31 moves. This throttle portion 23*a* is formed, as shown in FIGS. 11 and 12, in a stepped shape where tapered portions and cylindrical portions are alternately arranged. Specifically, the following are provided: a first tapered portion 23*c* expanding toward the downstream side; a first parallel portion 23*f* formed in substantially the same diameter as the maximum diameter of the first tapered portion 23*c* so as to be continuous with the first tapered portion 23*c*; a second tapered portion 23*d* expanding toward the downstream side so as to be continuous with the first parallel portion 23*f*; a second parallel portion 23*g* formed in substantially the same diameter as the maximum diameter of the second tapered portion 23*d* so as to be continuous with the second tapered portion 23*d*; a third tapered portion 23*e* expanding toward the downstream side so as to be continuous with the second parallel portion 23*g*; and a third parallel portion 23*h* formed in substantially the same diameter as the maximum diameter of the third tapered portion 23*e* so as to be continuous with the third tapered portion 23*e*. This embodiment is merely an example and the number of steps of the stepped shape may be changed as appropriate.

The valve member 31 is structured so as to slide along with the depression of the operation portion 30. While the valve member 31 is pushed in the protruding direction by the valve member pushing member 36 under natural conditions, when the operation portion 30 is depressed against the pushing force of the valve member pushing member 36, the valve member 31 moves in the direction that opens the pipe line 23. In the present embodiment, the tip sealing member 32 formed of an O ring or the like is attached to the tip of the valve member 31, and under natural conditions, the pipe line 23 is closed by this tip sealing member 32 abutting on the throttle portion 23*a*. When the valve member 31 moves in the direction that opens the pipe line 23, a clearance occurs between the tip sealing member 32 and the throttle portion 23*a*, and by this clearance, the flow amount of the air in the pipe line 23 is controlled. Then, when the valve member 31 opens the pipe line 23, air is released from the air outlet 40, and air is jetted out of the nozzle 17*b*. In the present embodiment, it is unnecessary to dispose the duster pipe arrangement 42 inside the housing since the valve member 31 and the air outlet 40 are disposed in the pushing direction of the operation portion 30.

According to this structure, since the flow channel area can be stepwisely adjusted by the stepped shape, even when the pressure difference between in front of and behind the throttle portion 23*a* becomes small by operating the operation portion 30 to a certain extent and the pressure to jet out the air decreases, the decrease in the pressure can be compensated by the increase in the flow channel area, so that the relationship between the operation amount of the operation portion 30 and the amount of air jetted out of the nozzle 17*b* can be made close to a proportional relationship.

Figure 13A:
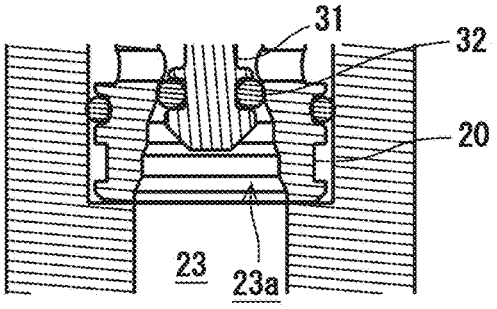
FIGS. 13A to 13E are views explaining the operation of the flow amount adjustment mechanism according to the second embodiment.
Figure 13B:
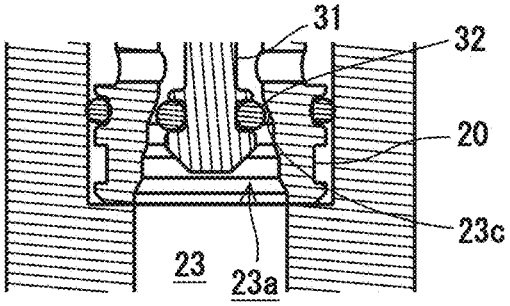
Figure 13C:
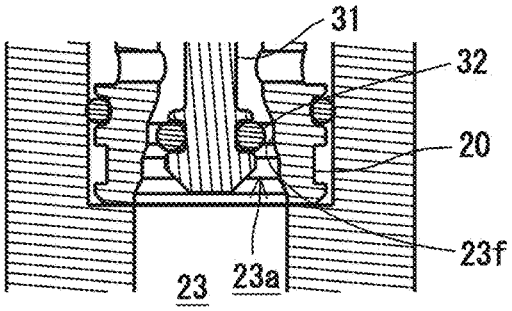
Figure 13D:
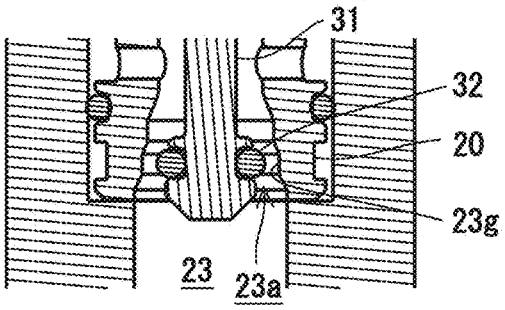
Figure 13E:
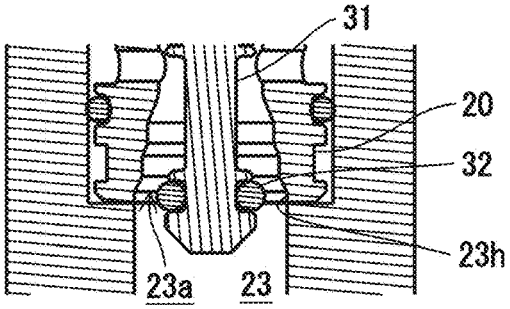
Figure 14:
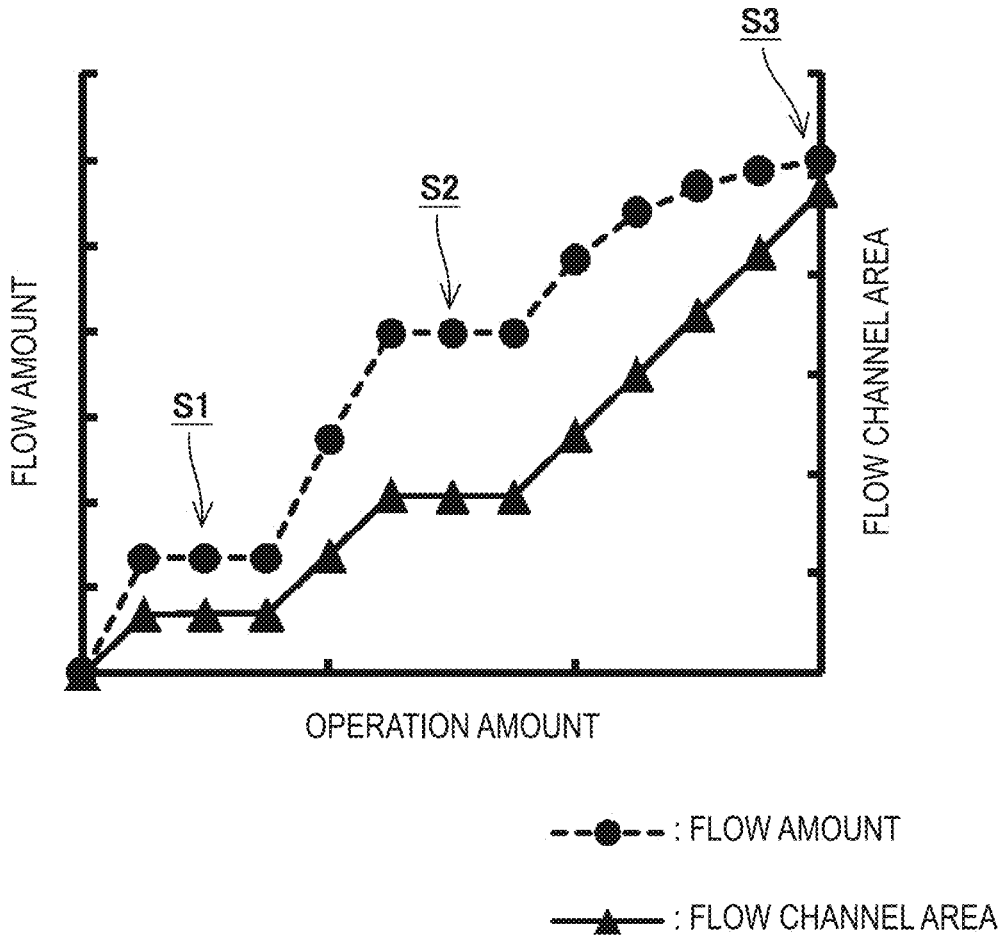
FIG. 14 is a graph showing a relationship between the operation amount, and the flow amount and the flow channel area according to the second embodiment.

That is, according to the present embodiment, as shown in FIG. 13B, when the tip sealing member 32 is moving in a position facing a tapered portion, the amount of clearance between the tip sealing member 32 and the throttle portion 23*a* increases little by little, whereas as shown in FIGS. 13C, 13D and 13E, when the tip sealing member 32 faces a parallel portion, the amount of clearance between the tip sealing member 32 and the throttle portion 23*a* does not change. For this reason, by adjusting the intervals and the diameters of the tapered portions and the parallel portions, the relationship between the operation amount of the operation portion 30 and the flow channel area can be easily set and changed. For this reason, even when the pressure difference between in front of and behind the throttle portion 23*a* becomes small by operating the operation portion 30 to a certain extent and the pressure to jet out the air decreases, the decrease in the pressure can be compensated by the increase in the flow channel area, so that as shown in FIG. 14, the relationship between the operation amount of the operation portion 30 and the amount of air jetted out of the nozzle 17*b* can be made close to a proportional relationship.

Moreover, by stepwisely adjusting the flow channel area, it is made easy to keep constant the amount of air jetted out of the nozzle 17*b*. For example, as shown in FIG. 13C, in a range where the tip sealing member 32 faces the first parallel portion 23*f*, as shown at S1 in FIG. 14, even if the operation amount of the operation portion 30 changes in some degree, the amount of air jetted out of the nozzle 17*b* is kept substantially constant. Likewise, as shown in FIG. 13D, in a range where the tip sealing member 32 faces the second parallel portion 23*g*, as shown at S2 in FIG. 14, even if the operation amount of the operation portion 30 changes in some degree, the amount of air jetted out of the nozzle 17*b* is kept substantially constant. Moreover, as shown in FIG. 13E, when the tip sealing member 32 is operated to a position where the tip sealing member 32 faces the third parallel portion 23*h* (to the bottom dead point), as shown at S3 in FIG. 14, the amount of air jetted out of the nozzle 17*b* is stabilized.

As described above, by making it possible to keep substantially constant the amount of air jetted out of the nozzle 17*b* even if the operation amount of the operation portion 30 changes in some degree, the amount of air jetted out of the nozzle 17*b* can be kept constant without the user continuing to apply a constant force to the operation portion 30. For example, even in a situation where it is difficult to continue applying a constant force to the operation portion 30 such as a situation where the user uses the machine while shaking the nozzle 17*b* under a condition where he/she is holding the machine, the amount of air jetted out of the nozzle 17*b* can be kept constant.

Third Embodiment

A third embodiment of the present disclosure will be described with reference to FIGS. 15 to 19. Since the third embodiment is different from the first embodiment only in the structure of the flow amount adjustment mechanism, overlapping descriptions are avoided and only the flow amount adjustment mechanism will be described.

Figure 15:
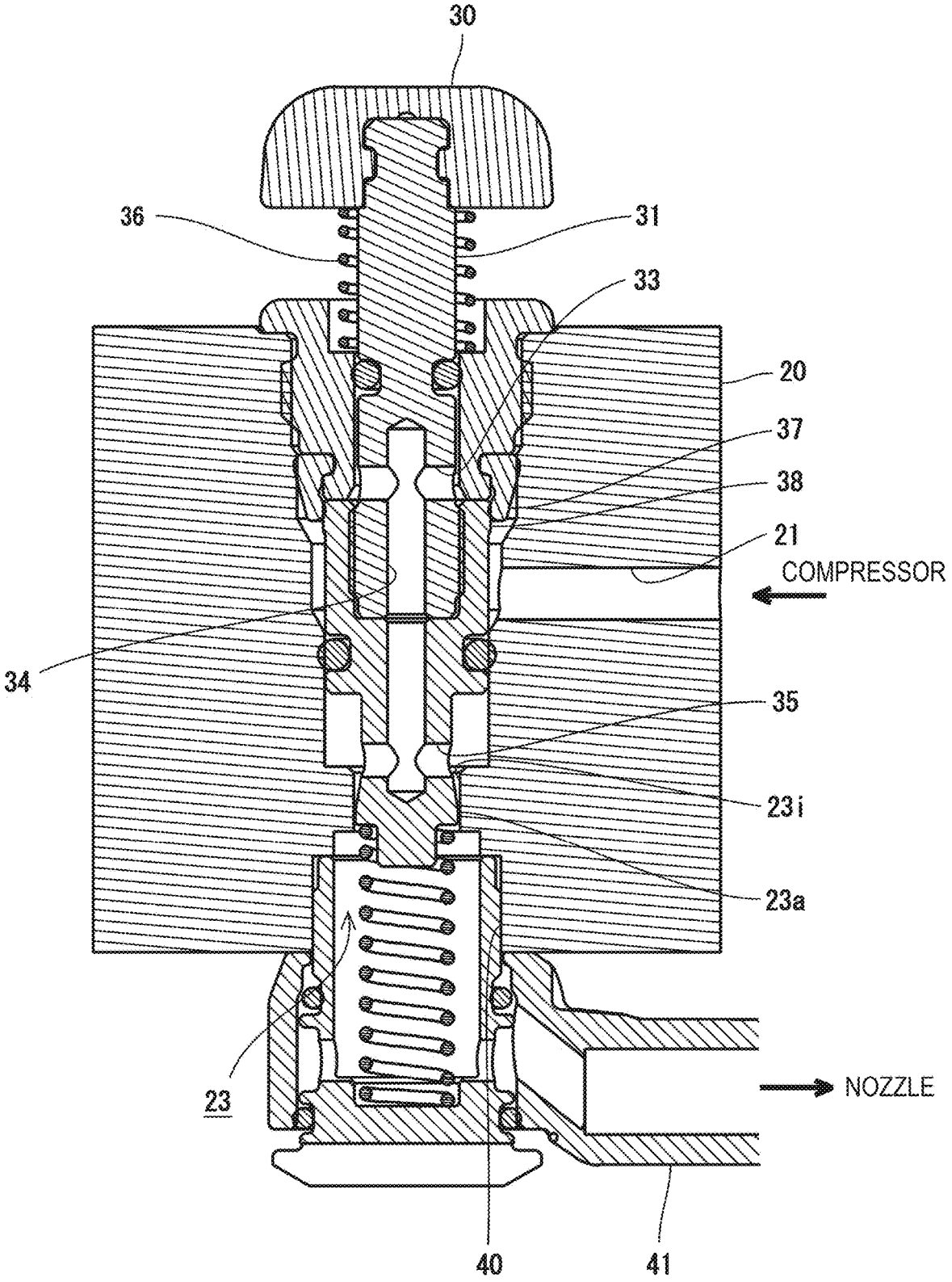
FIG. 15 is a cross-sectional view of a flow amount adjustment mechanism according to a third embodiment, and a view of a condition where the operation portion is not operated.
Figure 16:
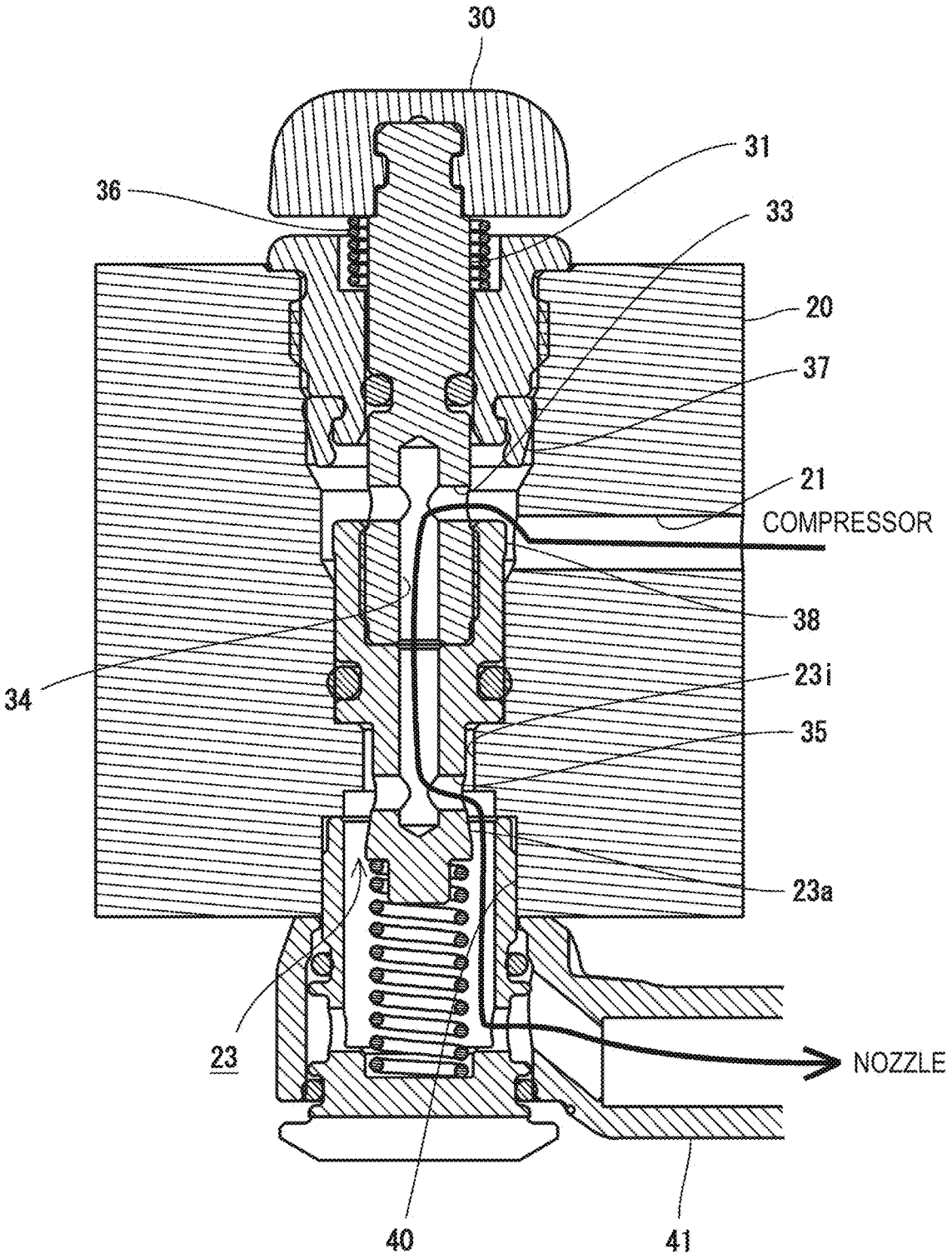

The flow amount adjustment mechanism according to the present embodiment is for adjusting the amount of air jetted out of the nozzle 17*b*, and as shown in FIG. 15, is provided with the pipe line formation portion 20 forming the pipe line 23 for circulating air, the valve member 31 disposed within the pipe line 23 and movable, the operation portion 30 disposed on the tip of the valve member 31 so as to be operable, the valve member pushing member 36 that pushes the valve member 31 in the protruding direction, and a sealing member 37 that abuts the valve member 31 to seal the air. Into this flow amount adjustment mechanism, the compressed air can be introduced from the upstream side, and when the air supply source such as an air compressor is connected, the compressed air is supplied to the upstream side at all times. On the downstream side of this flow amount adjustment mechanism, the air outlet 40 to which the duster pipe arrangement 42 (the joint part 41) is connectable is open. The pipe line formation portion 20 has a hollow portion forming the pipe line 23, and in the present embodiment, part of the housing of the tool body 11 is made the pipe line formation portion 20. That is, in the housing of the tool body 11, a through hole that passes through in a direction orthogonal to the driving direction of the fastener is formed, and the pipe line 23 is formed of this through hole. This pipe line formation portion 20 is structured, as shown in FIG. 16, so as to take in the compressed air into the pipe line 23 from the upstream opening portion 21 that is open toward the upstream side. This pipe line formation portion 20 is provided with a blocking portion 23*i* capable of adjusting the opening amount of an opening portion 35 described later. The blocking portion 23*i* has a cylinder inner surface shape facing the outer peripheral surface of the valve member 31.

The valve member 31 is structured so as to slide along with the depression of the operation portion 30. While the valve member 31 is pushed in the protruding direction by the valve member pushing member 36 under natural conditions, when the operation portion 30 is depressed against the pushing force of the valve member pushing member 36, the valve member 31 moves in the direction that opens the pipe line 23.

This valve member 31 is hollow and provided with an inner pipe line 34 through which air can pass. On the upstream side of the inner pipe line 34, an intake 33 for taking in the compressed air is provided, and on the downstream side of the inner pipe line 34, the opening portion 35 for discharging the compressed air toward the air outlet 40 is provided. The compressed air supplied from the air supply source flows into the inner pipe line 34 from the intake 33, and passes through the opening portion 35 to flow in a direction toward the air outlet 40. The opening portion 35 is open in a direction orthogonal to the movement direction of the valve member 31, and can face the blocking portion 23*i* of the pipe line formation portion 20. Specifically, this opening portion 35 is provided, as shown in FIGS. 17A to 17D, continuously with the throttle portion 23*a* described later, and after the valve member 31 moves and the throttle portion 23*a* passes the blocking portion 23*i*, the opening portion 35 faces the blocking portion 23*i*.

On the downstream side of this opening portion 35, the throttle portion 23*a* is provided that controls the flow amount of the air in the pipe line 23 by gradually changing the amount of clearance between the pipe line 23 and the valve member 31 when the valve member 31 moves. While the throttle portion 23*a* is formed by tapering the outer peripheral surface of the valve member 31 in the present embodiment, the present disclosure is not limited thereto; the throttle portion 23*a* may be formed by tapering the inner peripheral surface of the pipe line 23 or a stepped shape may be used instead of the tapered shape.

In the present embodiment, the sealing member 37 formed of an O ring or the like is fixed to the housing side of the tool body 11. Under natural conditions, as shown in FIG. 15, this sealing member 37 abuts on the outer peripheral surface (a sealing surface 38) of the valve member 31 to seal so that no air flows into the intake 33. When the valve member 31 moves in the direction that opens the pipe line 23, the sealing state of the sealing member 37 and the sealing surface 38 is released, so that air is supplied from the intake 33 to the inner pipe line 34. The flow amount of the air supplied to the inner pipe line 34 is controlled by the change in the clearance amount at the throttle portion 23*a* and the change in the opening amount of the opening portion 35. The air having its flow amount controlled is released from the air outlet 40 and jetted out of the nozzle 17*b*. In the present embodiment, it is unnecessary to dispose the duster pipe arrangement 42 inside the housing since the valve member 31 and the air outlet 40 are disposed in the pushing direction of the operation portion 30 and the air outlet 40 is formed on the side opposite to the operation portion 30.

According to this structure, since the flow channel area can be stepwisely adjusted by the flow amount adjustment at two places, even when the pressure difference between in front of and behind the throttle portion 23*a* becomes small by operating the operation portion 30 to a certain extent and the pressure to jet out the air decreases, the decrease in the pressure can be compensated by the increase in the flow channel area, so that the relationship between the operation amount of the operation portion 30 and the amount of air jetted out of the nozzle 17*b* can be made close to a proportional relationship.

Figure 17A:
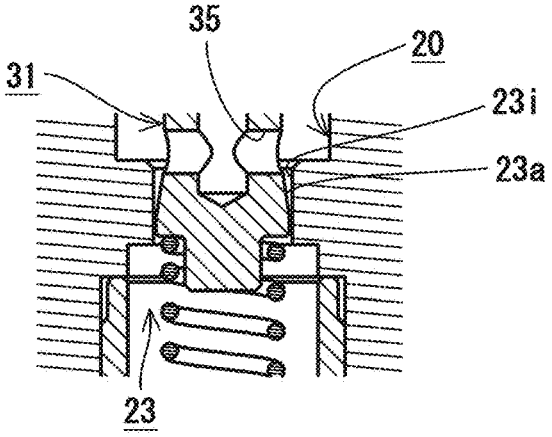
FIGS. 17A to 17D are views explaining the operation of the flow amount adjustment mechanism according to the third embodiment.
Figure 17B:
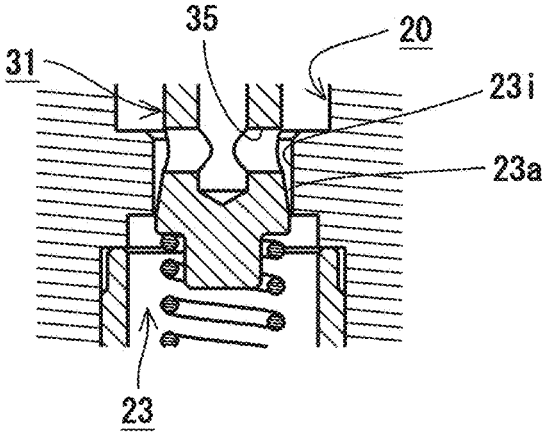
Figure 17C:
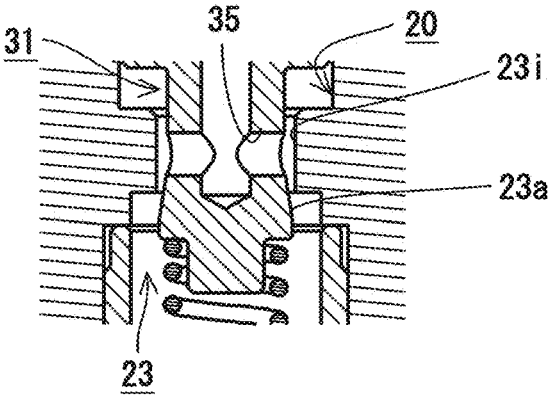
Figure 17D:
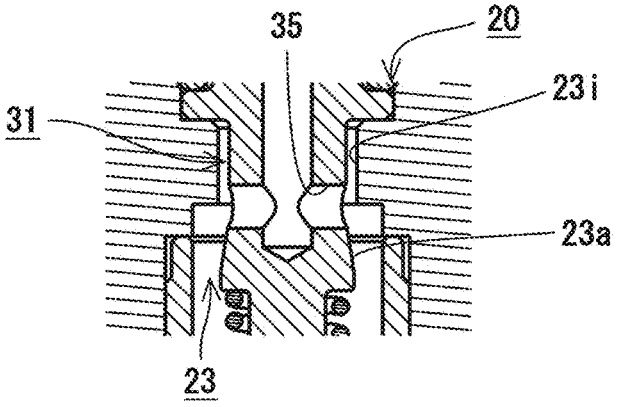
Figure 18A:
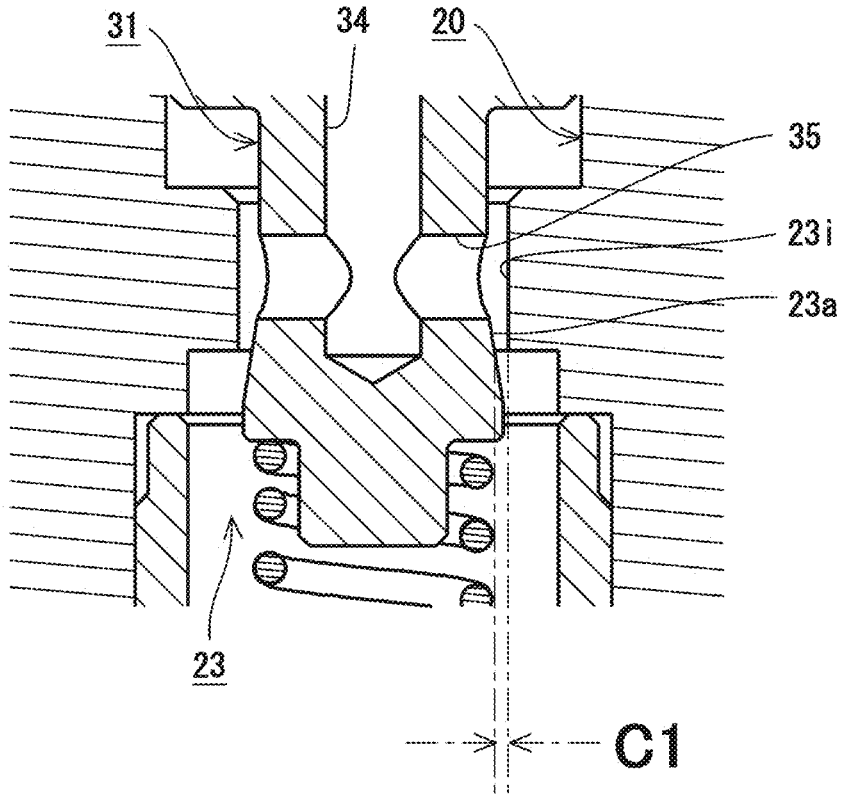
FIGS. 18A and 18B are views explaining a stepwise adjustment of the flow channel area according to the third embodiment.
Figure 18B:
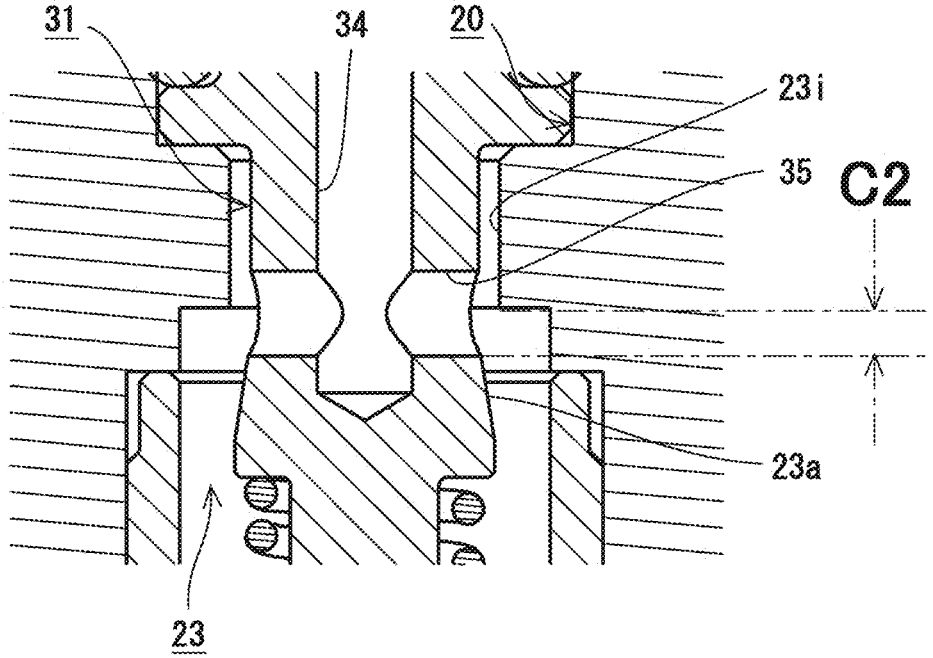

That is, according to the present embodiment, as shown in FIGS. 17A to 17C, since the opening portion 35 is blocked until the operation portion 30 is operated and moves to a predetermined position, the flow amount adjustment is performed only by the throttle portion 23*a*. At this stage, as shown in FIG. 18A, the flow amount of the air is controlled by the change in the amount of clearance between the throttle portion 23*a* and the blocking portion 23*i*. Then, as shown in FIG. 17D, when the operation portion 30 is further operated and moves to the predetermined position, part of the opening portion 35 moves to the downstream side of the blocking portion 23*i*, so that the air flows directly to the downstream side from the opening portion 35. At this stage, the flow amount adjustment by the throttle portion 23*a* is not performed, and as shown in FIG. 18B, the flow amount of the air is controlled by the change in the opening amount of the opening portion 35.

Figure 19:
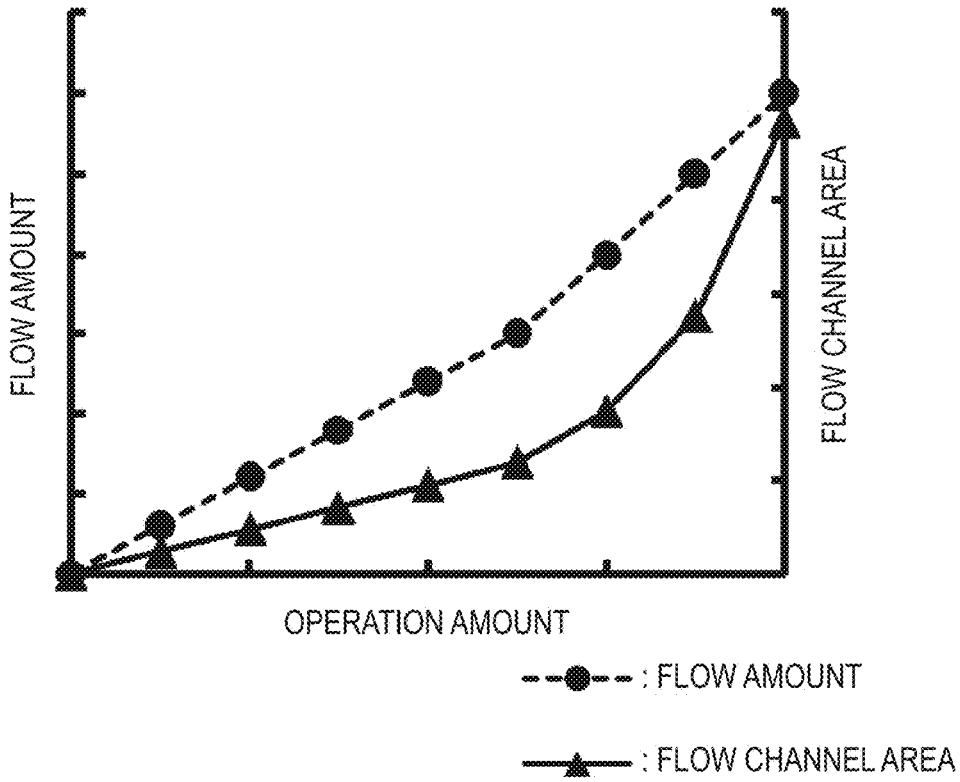
FIG. 19 is a graph showing a relationship between the operation amount, and the flow amount and the flow channel area according to the third embodiment.

According to this structure, the flow amount of the air can be increased as a stretch when the operation portion 30 is operated to a certain extent. For this reason, even when the pressure difference between in front of and behind the throttle portion 23*a* becomes small by operating the operation portion 30 to a certain extent and the pressure to jet out the air decreases, the decrease in the pressure can be compensated by the increase in the flow channel area, so that as shown in FIG. 19, the relationship between the operation amount of the operation portion 30 and the amount of air jetted out of the nozzle 17*b* can be made close to a proportional relationship.

While in the above-described embodiment, the flow amount of the air in the pipe line 23 is controlled by the change in the clearance amount at the throttle portion 23*a* and the change in the opening amount of the opening portion 35, the method of adjusting the flow channel area by the flow amount adjustment at two places is not limited thereto. That is, at least two throttle portions where the flow channel area change amounts with respect to the movement amount of the valve member 31 are different may be provided. For example, a throttle portion where the change in the flow channel area is small and a throttle portion where the change is large may be combined. Specifically, by providing two or more tapered throttle portions as described in the first embodiment and making the angles of the tapered surfaces of the throttle portions different from each other, the flow channel area change amounts with respect to the movement amount of the valve member 31 can be made different from each other.

In the above-described embodiment, the opening portion 35 is provided on the valve member 31, and the blocking portion 236*i* is provided on the pipe line formation portion 20 (the pipe line 23). However, the opening portion 35 may be provided on the pipe line formation portion 20 (the pipe line 23), and the blocking portion 23*i* may be provided on the valve member 31.

According to an aspect of the disclosure, there is provided an air duster structure that is configured to jet compressed air out of a nozzle, the air duster structure comprising: a flow amount adjustment mechanism which is configured to adjust an amount of air jetted out of the nozzle, wherein the flow amount adjustment mechanism includes: a pipe line for circulating air; a valve member disposed inside the pipe line and being movable; and a throttle portion configured to gradually change an area of a flow channel in which air circulates, with a movement of the valve member, to control a flow amount of the air in the pipe line, and the throttle portion is structured so as to increase the area of the flow channel at an accelerated rate when the valve member moves in a direction that opens the pipe line.

In the above described structure, the throttle portion is structured so as to increase the area of the flow channel at an accelerated rate when the valve member moves in the direction that opens the pipe line. According to the structure, as the operation amount increases, the flow channel area of the throttle portion increases at an accelerated rate. Therefore, even when the pressure difference between in front of and behind the throttle portion becomes small by operating the operation portion to a certain extent and the pressure in an accumulator decreases, the decrease in the pressure can be compensated by the increase in the flow channel area, so that the relationship between the operation amount of the operation portion and the amount of air jetted out of the nozzle can be made close to a proportional relationship.

According to an aspect of the disclosure, there is provided an air duster structure that is configured to jet compressed air out of a nozzle, the air duster structure comprising: a flow amount adjustment mechanism which is configured to adjust an amount of air jetted out of the nozzle, wherein the flow amount adjustment mechanism includes: a pipe line for circulating air; a valve member disposed inside the pipe line and being movable; and a throttle portion configured to gradually change an area of a flow channel in which air circulates, with a movement of the valve member, to control a flow amount of the air in the pipe line, and the throttle portion has a stepped shape where the area of the flow channel is stepwisely changed when the valve member moves.

In the above described structure, the throttle portion has the stepped shape where the area of the flow channel is stepwisely changed when the valve member moves. According to the structure, the flow channel area can be stepwisely adjusted by the stepped shape. Therefore, even when the pressure difference between in front of and behind the throttle portion becomes small by operating the operation portion to a certain extent and the pressure to jet out the air decreases, the decrease in the pressure can be compensated by the increase in the flow channel area, so that the relationship between the operation amount of the operation portion and the amount of air jetted out of the nozzle can be made close to a proportional relationship.

By stepwisely adjusting the flow channel area, it is made easy to keep constant the amount of air jetted out of the nozzle. That is, if the release valve or the pipe line is formed in the tapered shape and the amount of air is adjusted, the operation amount of the operation portion directly affects the amount of air being jetted out, so that in order to keep constant the amount of air jetted out of the nozzle, it is necessary that the operation amount of the operation portion be also kept constant. For this reason, it is difficult to keep constant the amount of air jetted out of the nozzle in a situation where it is difficult for the user to continue applying a constant force to the operation portion (for example, in a situation where the user uses the machine while shaking the nozzle under a condition where he/she is holding the machine). In this regard, according to the present disclosure, since the amount of air jetted out of the nozzle can be kept substantially constant even if the operation amount of the operation portion changes in some degree, the amount of air jetted out of the nozzle can be kept constant without the user continuing to apply a constant force to the operation portion.

According to an aspect of the disclosure, there is provided an air duster structure that is configured to jet compressed air out of a nozzle, the air duster structure comprising: a flow amount adjustment mechanism which is configured to adjust an amount of air jetted out of the nozzle, wherein the flow amount adjustment mechanism includes: a pipe line for circulating air; a valve member disposed inside the pipe line and being movable; and at least two throttle portions configured to gradually change areas of flow channels in which air circulates, with a movement of the valve member, to control a flow amount of the air in the pipe line, and change amounts of the areas of the flow channels of the throttle portions with respect to a movement amount of the valve member are different from each other.

In the above described structure, at least two throttle portions are provided where the flow channel area change amounts with respect to the movement amount of the valve member can be made different from each other. According to the structure, the flow channel area can be stepwisely adjusted by the flow amount adjustment at two places. Therefore, even when the pressure difference between in front of and behind the throttle portion becomes small by operating the operation portion to a certain extent and the pressure to jet out the air decreases, the decrease in the pressure can be compensated by the increase in the flow channel area, so that the relationship between the operation amount of the operation portion and the amount of air jetted out of the nozzle can be made close to a proportional relationship.

The throttle portion may be configured to gradually change an amount of clearance between the pipe line and the valve member when the valve member moves, to control the flow amount of the air in the pipe line. In this case, the flow channel area can be changed by the change of the clearance amount.

According to an aspect of the disclosure, there is provided an air duster structure that is configured to jet compressed air out of a nozzle, the air duster structure comprising: a flow amount adjustment mechanism which is configured to adjust an amount of air jetted out of the nozzle, wherein the flow amount adjustment mechanism includes: a pipe line for circulating air; a valve member disposed inside the pipe line and being movable; and a throttle portion configured to gradually change an amount of clearance between the pipe line and the valve member when the valve member moves, an opening portion that is open in a direction orthogonal to a direction in which the valve member moves is provided on one of the pipe line or the valve member, a blocking portion capable of adjusting an opening amount of the opening portion is provided on the other of the pipe line or the valve member, and the flow amount adjustment mechanism is configured to control a flow amount of the air in the pipe line by a change of the clearance amount at the throttle portion and a change of the opening amount of the opening portion.

In the above described structure, the flow amount of the air in the pipe line is controlled by the change of the clearance amount at the throttle portion and the change of the opening amount of the opening portion. According to the structure, the flow channel area can be stepwisely adjusted by the flow amount adjustment at two places. Therefore, even when the pressure difference between in front of and behind the throttle portion becomes small by operating the operation portion to a certain extent and the pressure to jet out the air decreases, the decrease in the pressure can be compensated by the increase in the flow channel area, so that the relationship between the operation amount of the operation portion and the amount of air jetted out of the nozzle can be made close to a proportional relationship.

According to an aspect of the disclosure, there is also provided a driving tool comprising the air duster structure, the driving tool configured to eject a fastener by using the compressed air.

According to an aspect of the disclosure, there is also provided a driving tool which includes an air duster structure that is configured to jet compressed air out of a nozzle, and which is configured to eject a fastener by using the compressed air, the driving tool comprising: an operation portion; a pipe line for circulating air; and a valve member which is configured to move in the pipe line with an operation to the operation portion, wherein, when the operation portion is operated, the compressed air is jetted out of the nozzle, and, when the operation portion is operated, the valve member moves in the pipe line, and an area of a flow channel in which air circulates is changed with the movement of the valve member so that a flow amount of the air in the pipe line is adjusted.

What is claimed is:

1. An air duster structure that configured to jet compressed air out of a nozzle, the air duster structure comprising:

a flow amount adjustment mechanism which is configured to adjust an amount of air jetted out of the nozzle, wherein the flow amount adjustment mechanism includes: a pipe line for circulating air; a valve member disposed inside the pipe line and being movable; and a throttle portion configured to change an area of a flow channel in which air circulates, with a movement of the valve member, to control a flow amount of the air in the pipe line, and the throttle portion is structured so as to increase the area of the flow channel at an accelerated rate, such that the area of the flow channel increases more rapidly than proportionally to a movement amount of the valve member when the valve member moves in a direction that opens the pipe line, and wherein a clearance is provided between the valve member and an inner surface of the pipe line, wherein the inner surface of the pipe line is configured such that, along a length portion of the inner surface of the pipe line, a size of the clearance increases at an accelerated rate such that the size of the clearance increases more rapidly than proportionally to the movement amount of the valve member when the valve member moves along the length portion of the pipe line in the direction which opens the pipe line.

2. A driving tool comprising the air duster structure according to claim 1, the driving tool configured to eject a fastener by using the compressed air.

3. The driving tool of claim 1, wherein the valve member includes a sealing member at an outer periphery thereof, and the clearance is between the sealing member and the inner surface of the pipe line.

4. An air duster structure that is configured to jet compressed air out of a nozzle, the air duster structure comprising:

a flow amount adjustment mechanism which is configured to adjust an amount of air jetted out of the nozzle, wherein the flow amount adjustment mechanism includes: a pipe line for circulating air; a valve member disposed inside the pipe line and being movable; and a changeable throttle portion configured to change an area of a flow channel in which air circulates, with a movement of the valve member, to control a flow amount of the air in the pipe line, and the changeable throttle portion includes a first portion and a second portion arranged to provide a stepped shape where the area of the flow channel is stepwisely changed when the valve member moves, wherein during movement of the valve member from a closed position to an open position an outer surface of the valve member first moves along the first portion and thereafter moves along the second portion, the area of the flow channel being changed with the movement of the valve member by a first degree as the outer surface of the valve member moves along the first portion, the area of the flow channel being changed with the movement of the valve member by a second degree as the outer surface of the valve member moves along the second portion, the first degree being larger than the second degree.

5. A driving tool comprising the air duster structure according to claim 4, the driving tool configured to eject a fastener by using the compressed air.

6. An air duster structure that is configured to jet compressed air out of a nozzle, the air duster structure comprising:

a flow amount adjustment mechanism which is configured to adjust an amount of air jetted out of the nozzle, wherein the flow amount adjustment mechanism includes: a pipe line for circulating air; a valve member disposed inside the pipe line and being movable; and at least two changeable throttle portions configured to change areas of flow channels in which air circulates, with a movement of the valve member, to control a flow amount of the air in the pipe line, the changeable throttle portions include a first throttle portion and a second throttle portion, the first throttle portion configured to control the flow amount of the air in the pipe line when a movement amount of the valve member is within a predetermined range and movement of the valve member changes a first clearance amount between the valve member and the pipe line at said first throttle portion when the movement amount of the valve member is within the predetermined range, the second throttle portion configured to control the flow amount of the air in the pipe line when the movement amount of the valve member exceeds the predetermined range and movement of the valve member changes a second clearance amount between the valve member and the pipe line at said second throttle portion when the movement amount of the valve member exceeds the predetermined range, and a change amount of an area of a flow channel of the second throttle portion with respect to a movement amount of the valve member outside the predetermined range is larger than a change amount of an area of a flow channel of the first throttle portion with respect to a same movement amount of the valve member within the predetermined range.

7. An air duster structure according to claim 4, wherein the changeable throttle portion includes a plurality of stepped shapes formed by alternating plural first portions and plural second portions.

8. A driving tool comprising the air duster structure according to claim 6, the driving tool configured to eject a fastener by using the compressed air.

9. An air duster structure that is configured to jet compressed air out of a nozzle, the air duster structure comprising:

a flow amount adjustment mechanism which is configured to adjust an amount of air jetted out of the nozzle, wherein the flow amount adjustment mechanism includes: a pipe line for circulating air; a valve member disposed inside the pipe line and being movable; and a changeable throttle portion configured to change an amount of clearance between the pipe line and the valve member when the valve member moves, an opening portion that is open in a direction orthogonal to a direction in which the valve member moves is provided on one of the pipe line or the valve member, a blocking portion capable of adjusting an opening amount of the opening portion is provided on the other of the pipe line or the valve member, and the flow amount adjustment mechanism is configured to control a flow amount of the air in the pipe line by a change of the amount of the clearance at the changeable throttle portion when a movement amount of the valve member is within a predetermined range, and is configured to control the flow amount of the air in the pipe line by a change of the opening amount of the opening portion when the movement amount of the valve member exceeds the predetermined range, and a change of the flow amount of the air due to the change of the opening amount of the opening portion is larger than a change of the flow amount of the air due to a change amount of the clearance.

10. A driving tool comprising the air duster structure according to claim 9, driving tool configured to eject a fastener by using the compressed air.

11. A driving tool which includes an air duster structure that is configured to jet compressed air out of a nozzle, and which is configured to eject a fastener by using the compressed air, the driving tool comprising:

an operation portion;

a pipe line for circulating air;

a valve member which is configured to move in the pipe line with an operation to the operation portion, wherein, when the operation portion is operated, the compressed air is jetted out of the nozzle, and, when the operation portion is operated, the valve member moves in the pipe line, wherein, the driving tool comprises a flow amount adjustment mechanism including at least two changeable throttle portions configured change an area of a flow channel in which air circulates according to a movement amount of the valve member so that a flow amount of the air in the pipe line is adjusted, wherein the at least two changeable throttle portions include a first throttle portion and a second throttle portion, and wherein the flow amount adjustment mechanism is configured to change from a flow amount adjustment with the first throttle portion to a flow amount adjustment with the second throttle portion such that the area of the flow channel increases more rapidly than proportionally to a movement amount of the valve member when the valve member moves in a direction that opens the pipe line, and wherein a change amount of the area of the flow channel with respect to a movement amount of the valve member for the flow amount adjustment with the second throttle portion is larger than a change amount of the area of the flow channel with respect to the movement amount of the valve member for the flow amount adjustment with the first throttle portion.

* * * * *